United States Patent [19]

Colin et al.

[11] 4,361,404

[45] Nov. 30, 1982

[54] MIXING EQUIPMENT AND AGITATOR THEREFOR FOR USE WITH GRANULAR MATERIAL AND METHOD OF PRODUCING PREPARED GRANULAR MATERIAL

[75] Inventors: Richard E. Colin, Roselle; Pete B. Pederson, Chicago, both of Ill.

[73] Assignee: Pettibone Corporation, Chicago, Ill.

[21] Appl. No.: 251,366

[22] Filed: Apr. 6, 1981

[51] Int. Cl.[3] ..... B02C 15/00; B02C 23/00

[52] U.S. Cl. ..... 366/2; 222/63; 241/110; 241/601; 366/43; 366/66; 366/192; 366/196; 366/298; 366/299; 366/300

[58] Field of Search ..... 366/2, 13–15, 366/42, 43, 64, 66, 77, 91, 96, 97, 132, 189, 192–196, 290–292, 297–300, 67, 309, 205; 241/101 B, 110, 124, 601; 222/63, 76, 233, 491, 504

[56] References Cited

U.S. PATENT DOCUMENTS

| | | | |
|---|---|---|---|
| Re. 25,475 | 11/1963 | McIlvaine et al. | 241/124 |
| Re. 28,659 | 12/1975 | Wenninger | 241/110 |
| 514,358 | 2/1894 | Grant | 366/300 |
| 3,231,146 | 1/1966 | Troy | 222/233 |
| 3,256,573 | 6/1966 | Hunter | 241/110 |
| 3,395,834 | 8/1968 | Troy | 222/63 |
| 3,567,139 | 3/1971 | Andrae | 241/601 |
| 3,666,243 | 5/1972 | Bisinella | 366/205 |
| 3,768,786 | 10/1973 | Troy | 366/66 |

*Primary Examiner*—Philip R. Coe
*Assistant Examiner*—Timothy F. Simone
*Attorney, Agent, or Firm*—Gerlach, O'Brien & Kleinke

[57] ABSTRACT

Mixing equipment includes a mixing compartment and at least one mulling assembly for dispersing therein material, including granular material, such as foundry sand. An agitator is provided for improving the mulling and aerating of the dispersed material within the compartment. The agitator includes a rotor rotated about an upright axis disposed within a cavity opening into the mixing compartment. The rotor includes a hub disposed within the cavity and having a plurality of fingers extending outwardly therefrom. Upon rotation of the rotor, the fingers move forcibly out of the cavity and into the mixing compartment to impact the material moving therepast, for mixing and aerating the material. An overflow discharge opening in a side wall of the compartment permits the prepared material to be discharged continuously from the mixing compartment. The supply of material to the compartment and the discharge of material are under the control of door, material consistency sensing, and timing apparatus. In order to interrupt efficiently the continuous production of prepared material, a controlled shutdown cycle of operation enables the mixing equipment either to resume production, if desired, following an interruption, or to cease production altogether.

35 Claims, 26 Drawing Figures

2
37
21
24
22
26
28
13
73
75
61
47
50
101
12
14
81
33
60
49
51
83
31
92
66
85
13
77
98
96
B
R
35
204
202
208
41
193
192
191
196
197
38
200
43
10
45
2

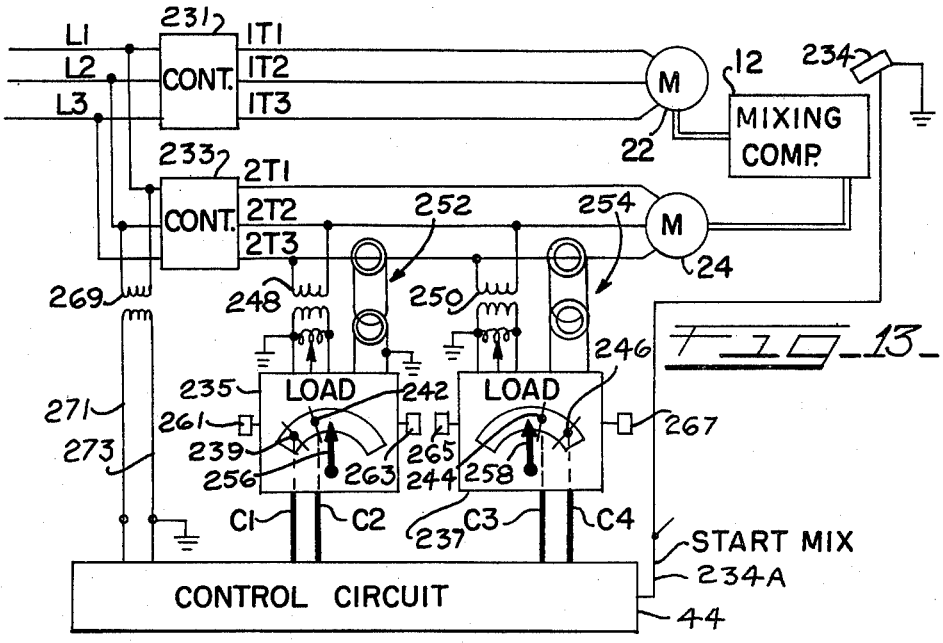
FIG. 13
FIG. 16
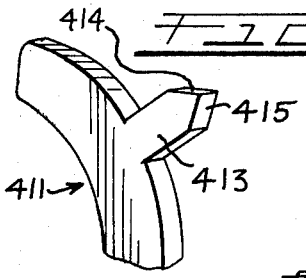
FIG. 17
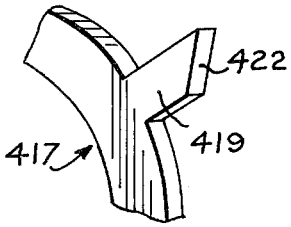
FIG. 18
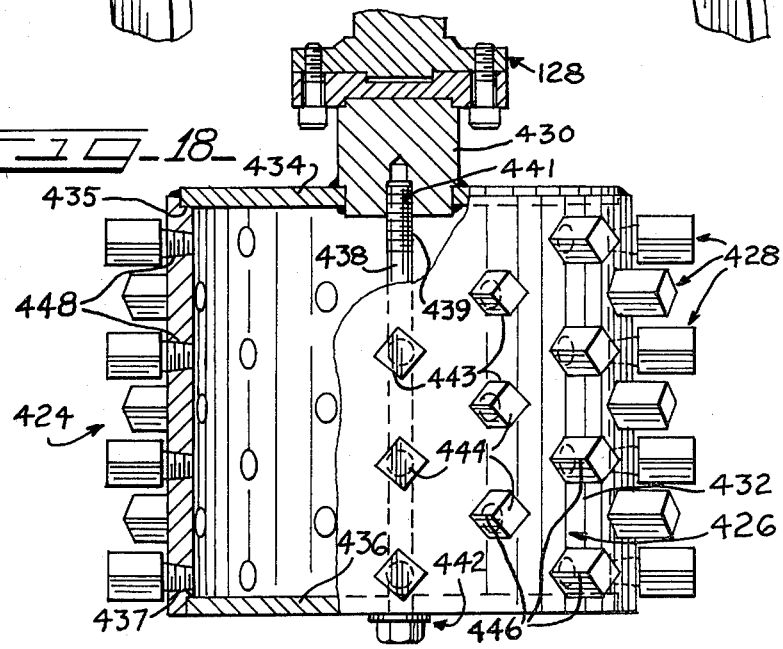

271
MANUAL
279
273
277
OFF
288
275
AUTO
313
MANUAL
315
START MIX
402
AUTO
325
323
234A
312A
290
292
MIX
321
294
317
319
329
C1(20%)
342
TIMER
327
300
301
C4(70%)
RESET
392
384
304
386
303
390
TIMER
379
377
CLOSE
BOTTOM DOOR
302
283
282
299
C3(50%)
C2(40%)
297
375
380
354
352
OPEN
TOP DOOR
284
285
348
356
296
C2
344
(40%)
346
369
OPEN
BOTTOM
DOOR
367
365
361
371
44
C3
298
373
(50%)
358
287
286

MIXING EQUIPMENT AND AGITATOR THEREFOR FOR USE WITH GRANULAR MATERIAL AND METHOD OF PRODUCING PREPARED GRANULAR MATERIAL

DESCRIPTION

1. Technical Field

The present invention relates in general to mixing equipment for use with granular material, to an agitator component of the equipment, and to a method of producing prepared granular material. More particularly, the invention relates to a continuous-flow mixing method and to equipment with which the method may be performed, to prepare mixture containing granular materials, such as sand mixtures, for making foundry molds and the like.

2. Background Art

Mixing equipment long has been used in foundries and other industrial operations for dispersing and for conditioning granular materials, such as sand for making foundry molds. For example, such equipment has included a single-stage batch type mixing bowl having a generally cylindrical side wall and a mulling assembly of mulling wheels and sand-elevating plows disposed centrally within the bowl. The mulling assembly is rotated about a vertical axis for dispersing sand together with a binder within the bowl, to produce a rolling and rotating torus of the sand mixture moving around the plow assembly. When the mixture has been processed to a suitable extent in this manner, the contents of the bowl are discharged for storage and/or use. A typical binder includes water, bentonite and cereal flour. For a more complete description of such a mulling assembly, reference may be made to the following U.S. Pat. Nos: Re. 28 659 and 3,663,243.

Multiple stage mixing equipment also has been employed for continuous flow operation. Illustrative equipment is disclosed in the following U.S. Pat. Nos: Re. 25,475 and 3,395,834. The multiple stage equipment of the patents includes a mixing compartment having a pair of generally cylindrical mixing bowl portions arranged in a side-by-side disposition with the interiors thereof communicating at a common opening in their side walls. A mulling assembly is rotated about a vertical axis within each bowl portion, to disperse and mull a mixture of sand and binder contained within the bowl portion. Material to be mixed is admitted to one of the bowl portions, and prepared or product material is discharged at the same rate from the other bowl portion.

In both the single and the multiple stage mixing equipment, the mulling assemblies disperse atmospheric air in the sand mixture to fluff it up, thus acting to avoid undesirable clustering of the mixture. The mulling wheels of the assemblies press the moving sand mixture against the inside surfaces of the bowl walls, to compress and thus mull it. The mulling action is a grain-to-grain rubbing of the sand, whereby the grains are dispersed and are coated with the binder material.

While the prior single and multiple stage mixing equipment has proven to be satisfactory for many applications, it would be highly desirable to facilitate or render more effective the aeration and the mulling of the sand mixture, thereby to minimize the formation of unwanted lumps and resulting caking of the prepared sand mixture and to increase the adequacy of the mulling, and also to minimize cycle times and the requirements for relatively expensive binders. Lumping or caking in a sand mixture is extremely undesirable for mold-making purposes. Should the sand not be adequately mulled, the binder tends to cluster and thus the grains of sand do not become evenly and completely coated with the binder, thereby rendering the resulting mixture unsatisfactory for its intended use.

When the multiple stage continuous flow mixing equipment is employed, the nature of the mixing is such that it is somewhat less thorough as compared to batch-type operations, and, consequently, the aeration and the mulling action likewise are less thorough. In this regard, some of the material entering the mixing compartment may exit directly therefrom without being mulled. Hence, it is particularly important to improve the aeration and the mulling action in continuous flow mixing equipment.

The prepared sand discharged from the mixing equipment may be conveyed to a storage bin. The prepared sand is transferred therefrom, as needed by the foundry mold-making equipment. After the molds are used for making desired parts, the spent sand molds are recycled to the mixing equipment, together with makeup sand. At times, it may become necessary to interrupt the production of prepared sand for various reasons. For example, the supply of one or more of the ingredients to the mixing equipment has inadvertently stopped, even momentarily, or the demand for prepared sand may be interrupted. When these conditions change or are corrected, and when prepared sand mixture again is called for, it is highly desirable that it be rapidly available, to avoid costly delays in the operation of the mold-making equipment.

SUMMARY OF INVENTION

An important object of the present invention is to provide new and improved mixing equipment, including an improved agitator, and a novel method of producing a mixture of material, including granular material, which equipment and method serve to more uniformly, completely and efficiently aerate and mull such material being dispersed in the equipment.

Another object is to provide equipment and a method of the foregoing character and which are adapted for continuous flow operation, wherein material to be mixed is continuously supplied to the equipment, mixed, and discharged from the equipment.

A further object of the present invention is to provide equipment and a method of the foregoing character, which serve to avoid delays in the production of the prepared material.

Briefly , the above and further objects of the present invention are achieved by providing mixing equipment having a mulling assembly and which further includes an agitator for improving the mulling and aerating of the material dispersed within the mixing equipment. More particularly, the mixing equipment includes a mixing compartment to which is supplied material to be mixed, including granular material, and a centrally-disposed mulling assembly rotatably mounted within the compartment for dispersing the material therewithin and causing it to enter into a suspension in air, moving about the mulling assembly. The agitator includes a rotor driven rotatably by motive means about an upright axis disposed within a cavity opening into the mixing compartment. The rotor includes a hub disposed within the cavity and having a plurality of fingers extending outwardly therefrom. Upon rotation of the rotor, the fingers move forcibly out of the cavity and into the mixing compartment to impact on the material moving therepast, for mixing and aerating the material.

In the preferred embodiments of the invention, the rotor hub has a substantially imperforate and smooth outer peripheral surface encompassing the hub therearound so as to reduce the frictional resistance exerted thereon by material therearound. The rotor is mounted with respect to an upright wall of the cavity, and is adapted with the motive means to exert a force exceeding the resistance to its rotation afforded by the material therearound.

The impacting fingers of the rotor are relatively short in their radially-extending length as compared to the diameter of the hub so that the impacting fingers are not subjected to unduly large bending moments acting on them by the dispersed material.

In a preferred form of the present invention, the mixing equipment is constructed for continuous flow operation. The mixing compartment includes a pair of side-by-side cup-shaped bowl portions disposed with their interiors in communication at a common opening in side walls thereof. Each one of the bowl portions has rotatably mounted therewithin a mulling assembly for mulling and aerating the granular material within the bowl portion and interchanging the material between the bowl portions at their common opening. The cavity for the rotor preferably is disposed at the common opening between the two bowl portions for more complete and effective mixing and aeration. It is further preferred to employ a pair of similar rotors mounted at opposite sides of the common opening within their respective cavities. The rotors are positioned advantageously within a pair of streams of material interchanging between bowl portions. The rotor impacting fingers, when rotating on one side of their respective hubs, extend into the adjacent stream with their outer peripheries moving such that the flowing streams are impacted for mixing and aerating purposes.

In the production of prepared foundry sand, the sand is admited to one of the bowl portions, together with the binder and water, and the materials are mixed, aerated and mulled by the mulling assemblies and subsequently discharged from the other bowl portion. An overflow discharge opening is provided in the side wall of the latter bowl portion for that purpose, and it is spaced above the mulling assembly in such bowl portion. As the sand mixture becomes mulled, it becomes progressively stiffer in consistency and is thrown higher on the side wall, until it overflows through the discharge opening. In this matter, only properly mulled sand mixture is discharged from the mixing compartment.

It is highly desirable to avoid unwanted interruptions in supplying prepared sand mixture to the mold-making equipment typically employed in foundry operations, when it becomes necessary to shut down the mixing equipment due to an interruption in the supply or due to a lack of demand for the prepared sand. In order to provide an orderly, efficient operation of the mixing equipment, a discharge door closes the discharge opening and the material within the mixing compartment continues to be dispersed therein for a predetermined retention time, before either resuming further production, when needed, or unloading the retained material for a complete shut down. This unique shutdown operation enables the material within the mixing compartment to be thoroughly mixed and ready for either further production, without any further undue and unwanted costly delays, or unloading of the mixing compartment.

BRIEF DESCRIPTION OF DRAWINGS

The above-described and other objects, advantages and features of this invention and the manner of attaining them will become apparent and the invention itself will be best understood by reference to the following description of preferred embodiments of the invention taken in conjunction with the accompanying drawings, wherein:

FIG. 13 is a schematic drawing of the material consistency sensing apparatus of the mixing equipment of the present invention, which apparatus is operatively connected to a discharge door control circuit, represented in schematic form;

FIG. 16 is a pictorial fragmentary view of a second embodiment of a plate part of the rotor of an agitator of the present invention;

FIG. 17 is a pictorial fragmentary view of a third embodiment of a plate part of the rotor of an agitator of the present invention; and FIG. 18 is a fragmentary vertical sectional and elevational view of another embodiment of the agitator rotor of the present invention.

BEST MODE FOR CARRYING OUT THE INVENTION

Figure 1:
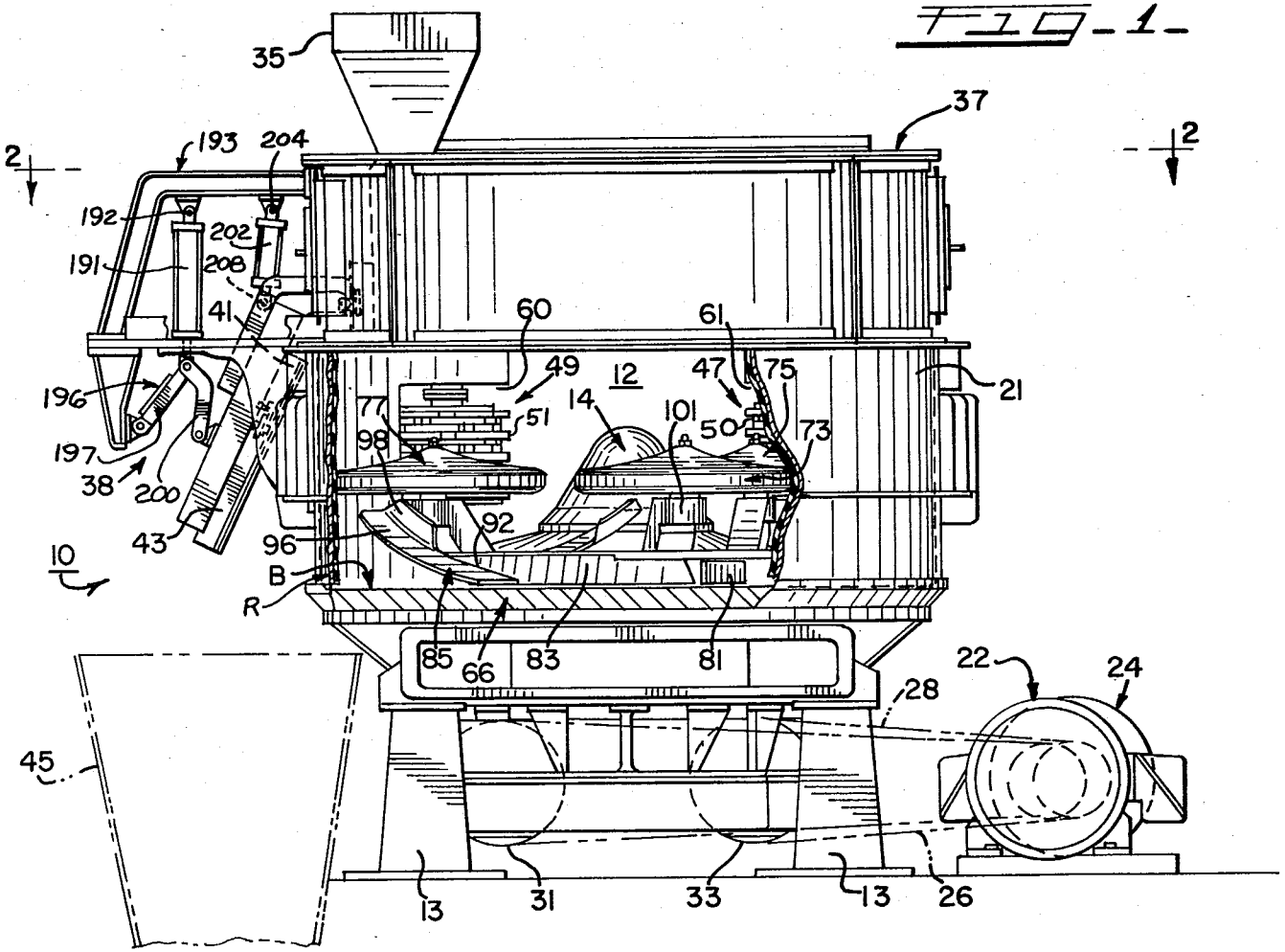
FIG. 1 is a right end elevational view of mixing equipment constructed in accordance with the present invention, illustrating the equipment with both discharge doors in their open positions and with a portion thereof broken away to expose one mulling assembly and the agitator rotors.
Figure 2:
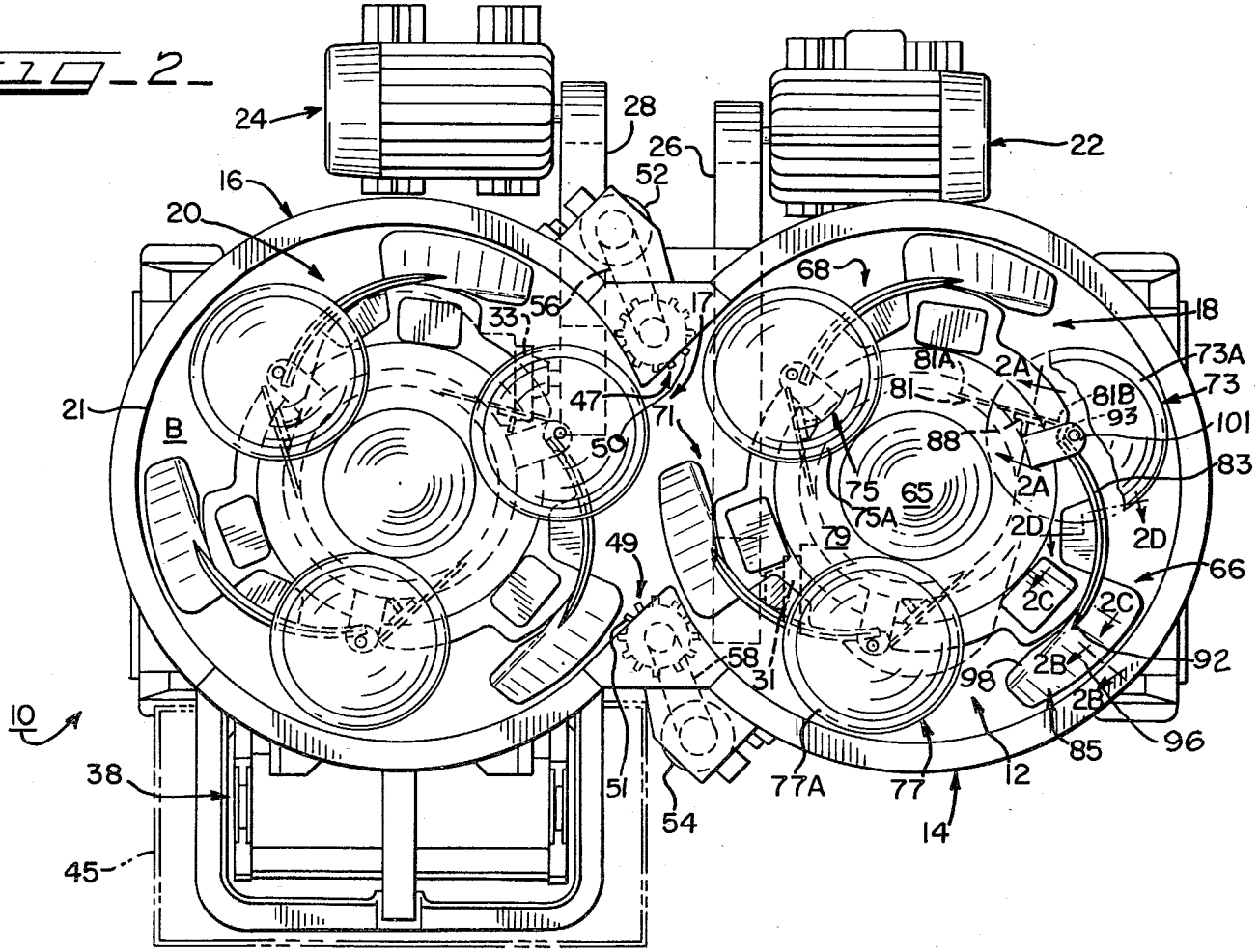
FIG. 2 is a horizontal sectional and plan view thereof taken substantially on line 2—2 thereof.

Referring now to the drawings, and more particularly to FIGS. 1, 2 and 13, there is shown mixing equipment 10, which is constructed in accordance with the present invention, and which is adapted to disperse granular material, such as sand, for making foundry molds and the like. The mixing equipment 10 includes an elongated mixing compartment generally indicated at 12, which is supported from below by a plurality of legs 13. The mixing compartment includes a pair of bowl portions 14 and 16, which are arranged in a side-by-side tandem arrangement to form a figure-eight configuration. The bowl portions 14 and 16 are joined together at a common opening 17 to interchange material between the two bowl portions. A pair of mulling assemblies 18 and 20 are rotatably mounted about their respective centrally disposed vertical axes of the respective bowl portions 14 and 16 for dispersing the material therewithin for mulling and aerating purposes.

As best seen in FIG. 2 of the drawings, the bowl portions 14 and 16 of the mixing compartment 12 have a common bottom wall B and a side wall 20, the inside of which is provided with a rubber lining R (FIG. 1). As best seen in FIG. 2 of the drawings, a pair of drive motors 22 and 24 are disposed under and to the rear of the mixing compartment 12 to rotate the respective plow and muller assemblies about their respective vertical axes within the respective bowl portions 14 and 16 in counterclockwise directions as viewed in FIG. 2 of the drawings. A pair of belt and pulley arrangements indicated at 26 and 28 connect drivingly the respective output shafts of the respective motors 22 and 24 to a pair of respective reduction gear assemblies 31 and 33, which in turn are connected drivingly to the respective plow and muller assemblies 18 and 20. For a more detailed description of a suitable manner for mounting the mulling assemblies 18 and 20 in a rotatable manner, reference may be made to the aforementioned U.S. patents Nos. Re. 28,659 and 3,663,243.

A material entry inlet hopper 35 is disposed above a cover or hood 37 mounted over the bowl portions 14 and 16 for conveying material to be mixed into the mixing compartment 12. The material entering the compartment 12 via the hopper 35 includes the granular material, such as sand, and a suitable binder, such as bentonite and cereal flour. Water is admitted within the compartment 12 to be dispersed with the other material to be mixed, from below the bottom wall B by suitable means (not shown). One suitable means for admitting the water is shown in the aforementioned U.S. Pat. No. Re. 28,659.

Figure 6:
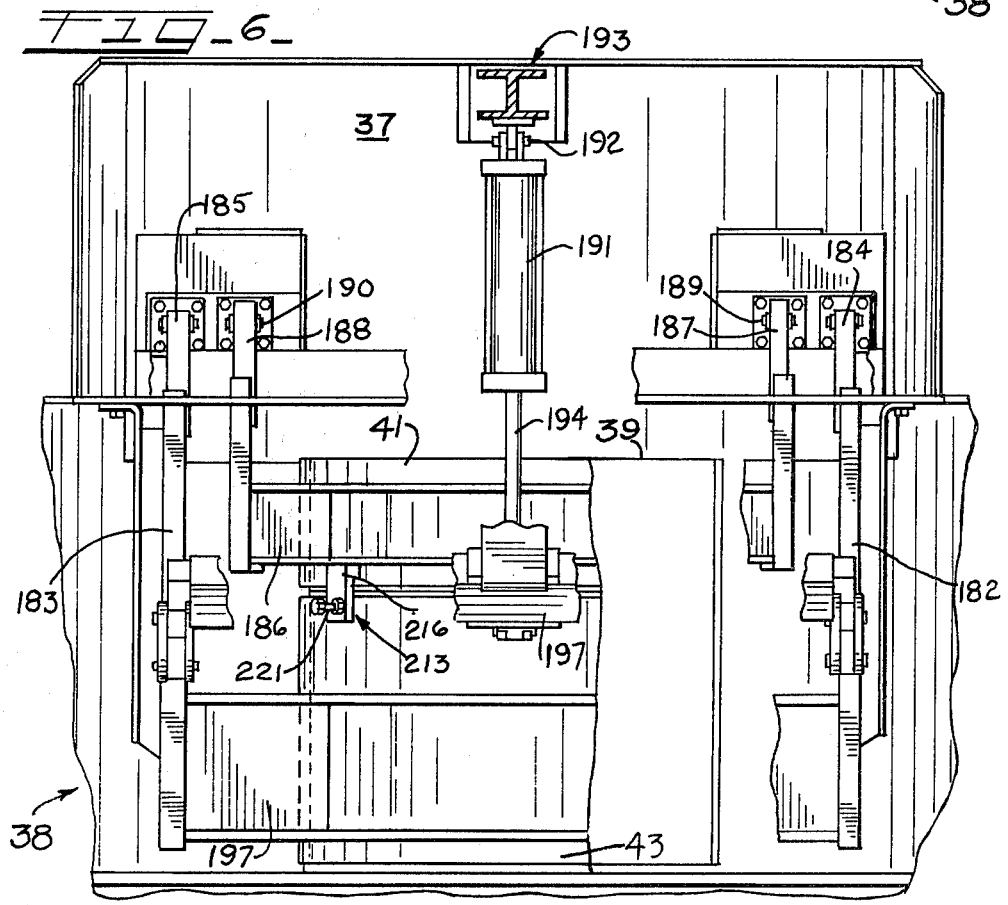
FIG. 6 is an enlarged fragmentary front elevational view thereof, illustrating the discharge doors in their closed positions.

As shown in FIGS. 1 and 2 of the drawings, discharge apparatus generally indicated at 38 in the side wall 20 at the discharge bowl portion 16 is adapted to convey prepared material from the interior of the discharge bowl portion 16 of the mixing compartment 12. As best seen in FIG. 6 of the drawings, the discharge apparatus 38 includes a discharge opening 39 in the side wall 20 at the front portion of the discharge bowl 16. The opening 39 is generally rectangular in shape, and it extends from the bottom wall B upwardly to a location spaced from the upper rim of the bowl portion 16. A small top door 41 and a large bottom door 43 swing outwardly away from the bowl portion 16 between open positions and closed positions covering over the discharge opening 39 as indicated in solid lines in FIG. 3 of the drawings. As shown in FIG. 13 of the drawings, a control circuit 44 enables the two discharge doors to be opened and closed in accordance with the method of the present invention as hereinafter described in greater detail and as illustrated schematically in FIG. 15 of the drawings.

A discharge hopper 45 receives the prepared material flowing from the discharge bowl portion 16 when the top door 41 is opened or both of the discharge doors are disposed in their open positions, to guide the prepared material to a conveyor belt or the like (not shown) to enable the prepared material to be transferred to a prepared material storage bin (not shown) so that mold-making equipment (not shown) can withdraw the prepared mixture product therefrom when needed. An enclosure (not shown) covers over the discharge hopper 45 and the discharge apparatus 38 during normal operation to insure that the discharged material enters the hopper 45.

In accordance with the present invention, there is provided a pair of like agitators generally indicated at 47 and 49, the agitators being mounted on opposite sides of the common opening 17. The agitators include rotors 50 and 51, respectively, which facilitate the agitation and breaking up of lumps or clusters formed in the dispersed material being interchanged between the bowl portions 14 and 16 via the common opening 17. Drive motors 52 and 54 provide motive power, which is transmitted by drive belts 56 and 58, respectively, for respective agitators 47 and 49.

Figure 2A:
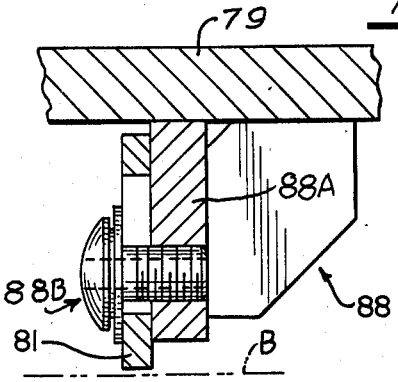
FIGS. 2A–2D are various vertical sectional views of the plow constructions of FIG. 2 taken on respective lines 2A–2D.
Figure 2B:
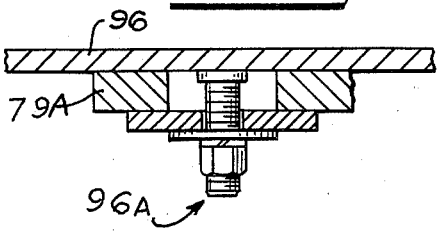
Figure 2C:
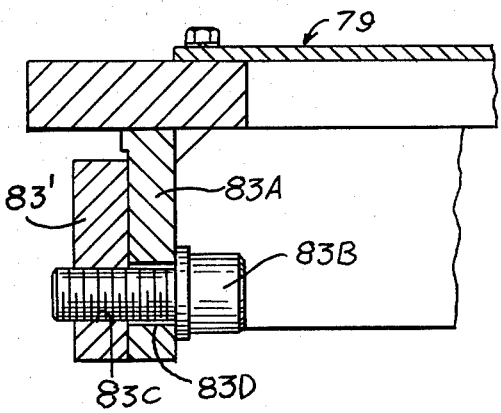
Figure 8:
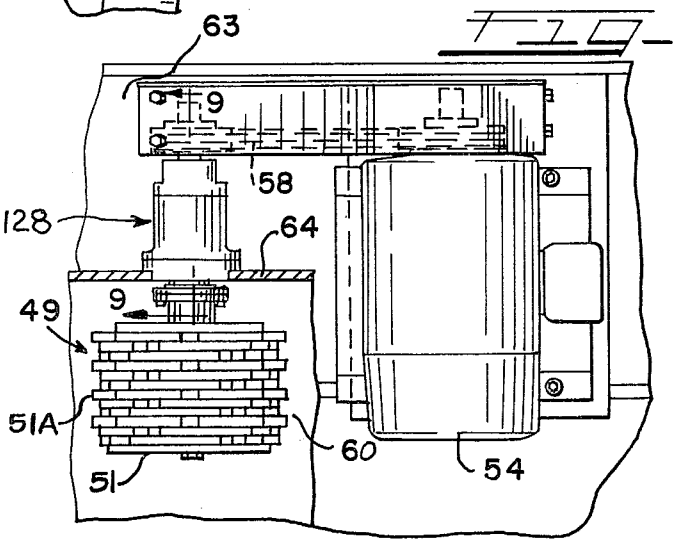
FIG. 8 is a vertical sectional elevational view of the structure shown in FIG. 7.
Figure 7:
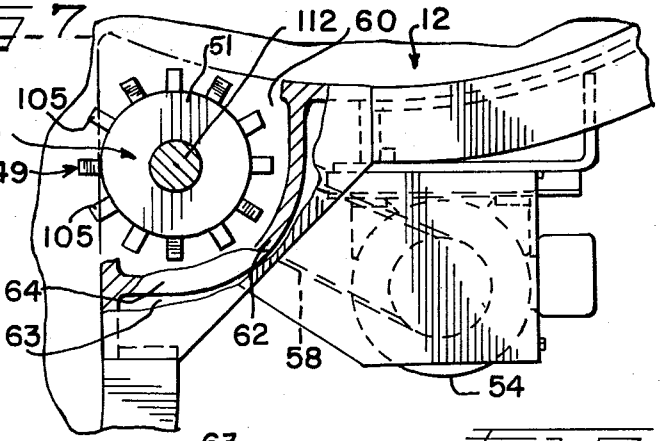
FIG. 7 is a further enlarged fragmentary, horizontal sectional view thereof, showing one or two identical agitator rotors thereof.

As shown in FIG. 1, two like rotor cavities 60 and 61 are formed on opposite sides of the common opening 17, for receiving the respective rotors 50 and 51. As best seen in FIGS. 2E, 7 and 8, each of the rotor cavities 60 and 61 is defined by concave back walls 62 or 62' having a cylindrically curved center section, and a flat horizontal internal ceiling wall 64 bordering a motor compartment 63. The rotors 50 and 51 are suspended from the respective ceiling walls 64 and are journaled for rotation about respective upright longitudinal axes thereof.

Referring now to FIGS. 1, 2 and 2E, the bowl portions 14 and 16 are generally cylindrical and cup-shaped in configuration. The bottom wall surfaces of the bowl portions 14 and 16 are generally circular in plan view, and are spaced apart by a slight distance at the common opening 17, as illustrated in phantom lines in FIG. 2E.

Considering now the flow of material in the mixing compartment 12 during operation thereof, the material in each bowl portion 14 or 16 is dispsered by a mulling assembly 18 or 20 in a rolling torus rotating about an upright axis in the same direction as the torus in the other bowl portion. In FIG. 2E, circles T1 and T2 represent the toruses, which are shown as by the pair of circles T1 and T2 indicating the counterclockwise directions of flow of the torus in each bowl portion as viewed in FIG. 2E of the drawings. The muller assemblies accelerate the material at the bottom portion of the bowl portions to form a suspension thereof and to push it tangentially upwardly toward and along the inside surface of the side wall 20, where it continues to rotate in the form of a rolling torus in each one of the bowl portions 14 and 16. A pair of streams S1 and S2 of material flow from the respective bowl portions 14 and 16 in opposite directions through the common opening 17 into the other bowl portions to interchange material between the bowl portions. The streams flow along paths extending tangentially away from the bowl portions past the rotating rotors at opposite sides of the opening 17 and into the other bowl portions. When entering the other bowl portions, each stream flows over the other rotating torus and into the interior thereof where the stream rolls with the torus as it rotates as indicated in FIG. 2E of the drawings.

The rotors 50 and 51 rotate in a clockwise direction as viewed in FIG. 2E of the drawings to provide a mixing action in the respective streams S1 and S2, and the rotors rotate at a much higher rate of speed than the speed of the streams S1 and S2 of material interchanging between the bowl portions to break apart and to aerate the material moving into engagement therewith. The outer peripheries of the rotors move so currently with and at a greater tangential rate of travel than the streams, thereby to impact on the material in the flow streams for mixing and aerating the material.

Plow and Mulling Assemblies

Considering now the mulling assemblies 18 and 20 in greater detail with reference to FIGS. 1 and 2 of the drawings, the two mulling assemblies are similar to one another, and therefore only the assembly 18 will now be described in greater detail. The assembly 18 generally comprises three similar sand-elevating plow constructions 66, 68 and 71 which are equally spaced apart about the periphery thereof. Three equally spaced-apart mulling wheels 73, 75 and 77 are rotatably mounted about their respective vertical axes at the periphery of the assembly 18 so that the wheels rotate with the assembly 18 as it rotates. The wheels include respective rubber tires 73A, 75A and 77A which press the dispersed material against the rubber lined inner side wall of the bowl portion 18 for mulling purposes. The hub 65 has a skirt portion 79 which carries the plow constructions and mulling wheels.

Considering now the plow constructions, only the plow construction 66 will now be described in greater detail, since the other two plow constructions are similarly constructed. The plow construction 66 generally comprises three plows 81, 83 and 85. As shown in FIGS. 2 and 2A of the drawings, a support bracket 88 for the plow 81 is fixed to and depends from the underside of the skirt portion 79 of the hub 65. The plow 81 is a generally flat elongated plate positioned with its longitudinal axis extending horizontally. The plate 81 extends longitudinally along a line from its leading end 81A spaced from the vertical axis of rotation of the mulling assembly 18 radially outwardly therefrom to its trailing end 81B near the axis of rotation of the mulling wheel 73. In this regard, the trailing end 81B of the plow plate 81 is disposed closer to the side wall 21 of the bowl portion 14 than its leading end 18A. As the assembly 18 rotates about its vertical axis in a counterclockwise direction as viewed in FIG. 2 of the drawings, the plow 81 pushes material at and near the floor B and guides it radially outwardly from a position near the axis of rotation of the assembly 18 toward the side wall and in front of the path of movement of the second plow 83. The intermediate plow 83 forces the material further outwardly toward the side wall 21.

The plow 83 is generally arcuate in its configuration from end to end, as seen in plan view in FIG. 2, and it has a radius of curvature generally similar to the radius of curvature of the bowl portion 14. The plow 83 is generally rectangular in cross section throughout its length and is spaced slightly above the bottom floor B of the bowl portion 14. A pointed trailing end 92 of the plow 83 is disposed closer to the side wall 21 than its leading end 93, to push the material toward the side wall 21 and into the path of movement of a lift section 96 (FIG. 1) of the outer plow 85.

Figure 2D:
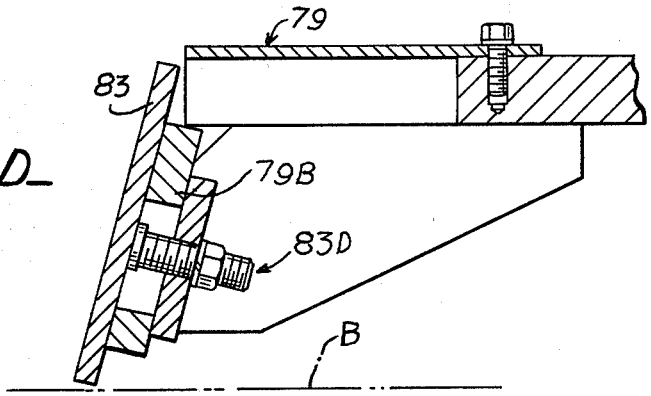
Figure 2E:
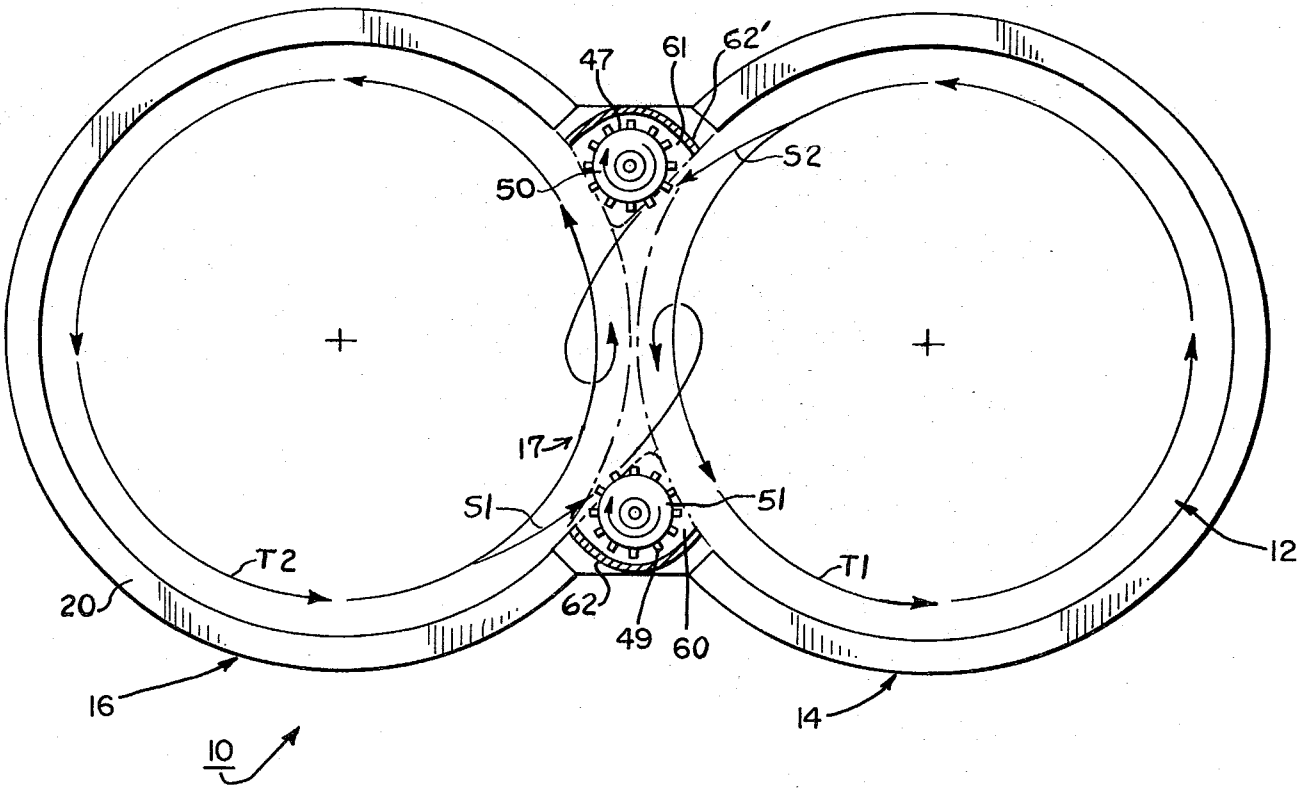
FIG. 2E is a partly schematic and horizontal sectional plan view similar to FIG. 2, with parts omitted, to illustrate the principal paths of motion of the dispersed material.

As best seen in FIG. 2D, the curved intermediate plow 83 is inclined slightly, upwardly and inwardly toward the axis of rotation of the assembly 18, to impart an upward component of movement to the material being pushed thereby. The plow 83 is mounted on an arm 79B fixed to the skirt portion 79 of the hub 65, by means of a welded bolt assembly generally indicated at 83D.

The outer plow 85 is disposed closer to the side wall 21 and is curved in its plan view, as seen in FIG. 2, having a radius of curvature similar to the radius of curvature of the bowl portion 14. As shown in FIGS. 1 and 2, the outer plow 85 extends upwardly from its generally horizontal leading end to the lift section 96, which provides a trailing end of the plow. An upstanding side wing section 98 is integral with the inside of the trailing end of the outer plow 85. The leading end of the outer plow 85 is adjacent to and beneath the trailing end 92 of the intermediate plow 83. The outer plow 85 pushes the material still higher upwardly toward and along the side wall 21 of the bowl portion 14.

By causing the granular material mixture to be pushed upwardly and generally in a tangential direction with respect to the inside surface of the side wall 21 of the bowl portion 14, the mixture is caused to move in a rolling torus rotating around the central vertical axis of the plow assembly 18 in a counterclockwise direction as viewed in FIGS. 2 and 2E.

As shown in FIG. 2B, the underside of the generally horizontal leading edge portion of the lift section 96 of the outer plow 85 is fixed to a horizontal portion of a bracket member 79A by means of a welded bolt assembly generally indicated at 96A, in a similar manner to the mounting arrangement shown in the above-mentioned U.S. Pat. No. 3,666,243. As shown in FIG. 2C, a vertical portion 83 of the bracket member 79A is fixed to a flange 83A depending from the underside of the skirt portion 79. A bolt 83B extends through an adjustment aperture or opening 83D in the flange 83A and into a tapped hole 83C in the member 83'.

As best seen in FIG. 1, the left section 96 of the outer plow 85 is upturned, to push the material upwardly. The uppermost portion of the left section 96 is disposed slightly below the bottom surfaces of the rotors 50 and 51 of the agitators 47 and 49. The rotors 50 and 51 thus depend into the respective streams S1 and S2, and terminate at their lower end portions at points at least slightly spaced above the outer material-elevating plows 85.

The material being pushed upwardly and toward the inside surface of the side wall 21 by the outer plows to flow into the torus rotating above the plows, is pushed very forcefully from the plows, without directly impacting upon the rotors. Otherwise, should material being dispersed from the three outer plows of each mulling assembly, flow forcefully into engagement with the lower portion of the rotors, they could be damaged or otherwise rendered inoperative. Thus, it has been found desirable to terminate the rotors at a position at least slightly above the outer plows to avoid unwanted impacting of the rotors. In this regard, material is accelerated at a high rate of speed by the mulling assemblies, at and near the bottom wall B. From there, the material flows into and forms the toruses, which rotated at a slower rate of speed. The streams S1 and S2 flow from the toruses, and are agitated by the rotors disposed therein. Therefore, should the rotors depend below the streams S1 and S2, there are necessarily greater electrical power and equipment to overcome resistance afforded by material moving at high rates of speed below the toruses.

Referring to the mulling wheel 73 as representative, the wheel is mounted for rotation about a vertical axis on an arm 101 (FIG. 2) carried by the skirt portion 79 of the hub 65. The mulling wheel 73 is slightly spaced from the inside surface of the rubberlining R on the side wall 21, so that the sand material flowing upwardly and therearound moves into a position between the rotating mulling wheel 13 and the side wall, for mulling the material between the wheel and the lining.

Agitators

Figure 9:
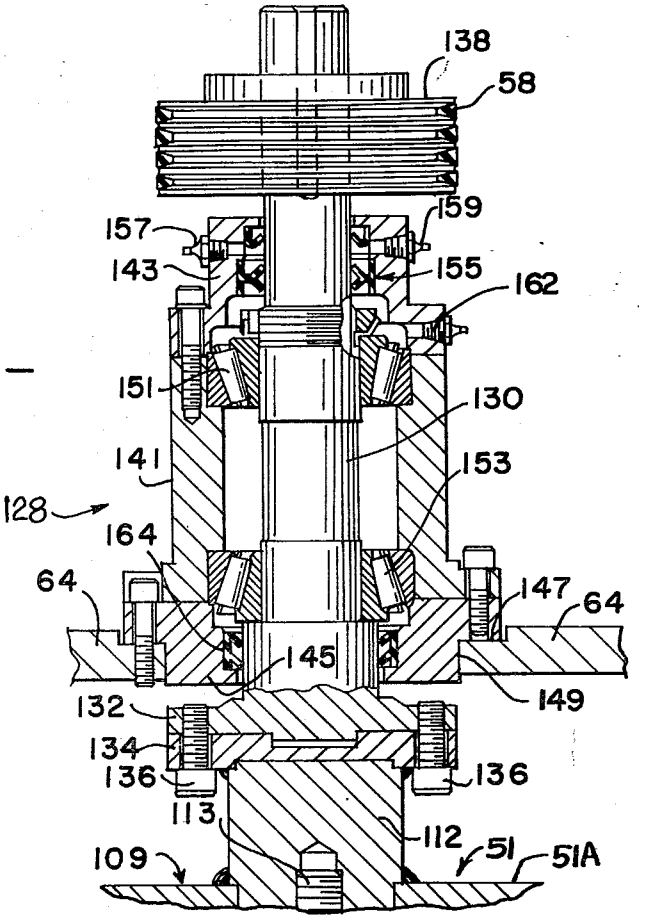
FIG. 9 is a still further enlarged fragmentary vertical sectional view of the equipment, taken substantially on line 9—9 of FIG. 8, showing the bearing assembly of the agitator.
Figure 10:
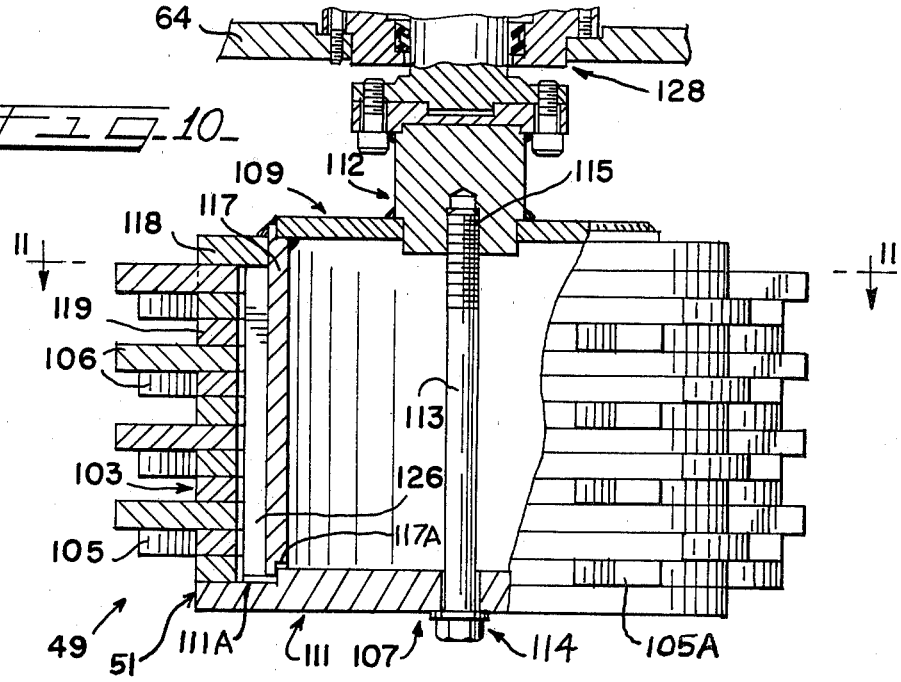
FIG. 10 is a similarly enlarged fragmentary vertical sectional and elevational view of the equipment, with parts broken away showing the stator.

Referring now to FIGS. 1, 2, 2E, 7, 8, 9 and 10, the agitators will now be considered in greater detail. Since the pair of agitators 47 and 49 are like one another, only the agitator 49 will now be described in further detail. As shown in FIG. 10, the agitator 49 includes the rotor 51, which has a generally cylindrical hub 103 and a plurality of impacting fingers 105, extending laterally outwardly from the hub 103. When the rotor 51 rotates about its vertical axis, the impacting fingers, when rotating on one side of the hub 103, extend into the adjacent stream S1 (FIG. 2E) of interchanging material, with the outer peripheries of the fingers 105 moving cocurrently with and at a greater tangential rate of travel than the stream S1. As a result, the fingers impact the material in the flowing stream for mixing and aerating the material. As best seen in FIGS. 2 and 2E, the impacting fingers are adapted to extend outwardly from the cavity 60 and into the mixing compartment 12 in turn as the rotor 51 is rotated for impacting material dispersed in the compartment. The hub 103 has a substantially imperforate and smooth outer peripheral surface encompassing the hub therearound so as to reduce unwanted frictional resistance exerted thereon by material therearound. The rotor 51 is mounted with respect to the upright wall 62 defining the rotor cavity 60, and is adapted with the motive means provided by the motor 54 to exert a force exceeding the resistance to its rotation afforded by the material therearound.

The impacting fingers 105 are arranged in axially extending rows substantially equidistantly spaced apart about the hub 103. The fingers 105 in each row are axially spaced apart, and the fingers in adjacent rows are axially staggered with respect to the fingers in adjacent rows. In this manner, the flow of material past the rotating rotor 51 of the agitator 49 moves through an irregular path of movement to facilitate the breaking up of lumps and aerating the sand mixture.

As best seen in FIG. 9, the top member 109 includes a neck portion 112, which enables the main body portion 51A of the rotor 51 to extend downwardly and be spaced from the ceiling wall 64 of the rotor cavity 60. In this manner, sand material flowing into the rotor cavity 60 compacts about the neck portion 112 to serve as a dynamic shaft seal thereby helping to protect components of the agitator above the rotor 51 as it rotates. A threaded rod or bolt 113 extends through the plate parts 106 to secure fixedly at its opposite ends the top and bottom members 109 and 111. A washer generally indicated at 114 is seated against the underside of the bottom member 111, and the upper end of the threaded rod 113 is tightened into a tapped hole 115 in the bottom end of the neck portion 112 of the top member 109.

Figure 11:
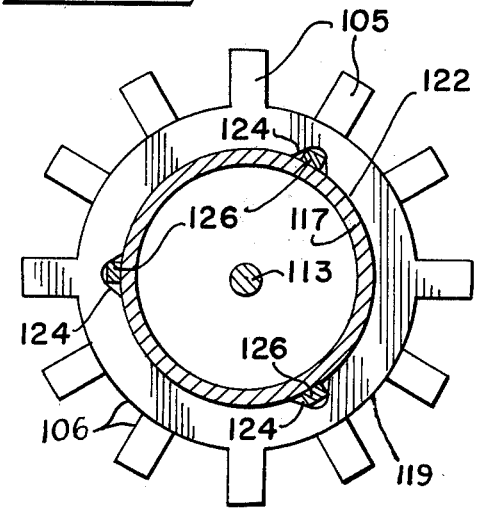
FIG. 11 is a horizontal sectional and plan view of the rotor, taken substantially on line 11—11 of FIG. 10.
Figure 12:
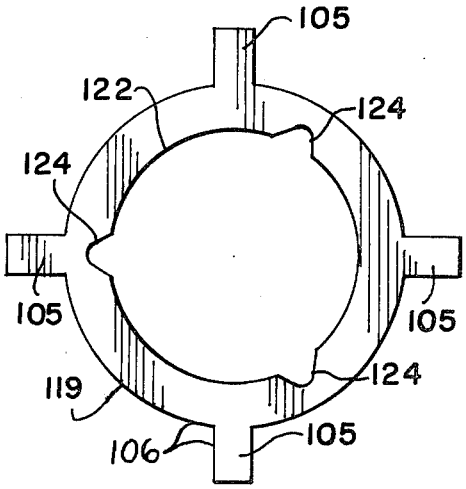
FIG. 12 is a plan view of a plate part of the rotor.

As shown in FIGS. 10, 11 and 12, the hub 103 is formed by a stack of a plurality of plate parts 106 having the impacting fingers 105 extending therefrom. A retaining device 107 holds the plate parts tightly together in a fixedly secure manner. The retaining device 107 includes a top member 109, which is generally circular in configuration, and a removable generally circular centrally-apertured bottom member 111.

An internal tube or core member 117 surrounds the rod 113 and has an internal annular shoulder 117A which fits into engagement with a complementary shaped annular shoulder 111A of the bottom member 111. An annular flange 118 is fixed to and surrounds the upper portion of the tube 117. The tube 117 and the top member 109, as well as the flange 118, are fixed together by any suitable technique, such as by welding. The plate parts 106 are clamped between the flange 118 and the bottom member 111. The bottom member 111 can be removed by loosening and then removing the threaded rod 113 so that the plate parts 106 can be slipped off of the tube 117 for replacing or repairing damaged plate parts.

As best seen in FIGS. 11 and 12 of the drawings, each one of the plate parts 106 includes a hub portion 119 which forms a part of the hub 103. The hub portion 119 has a central internal aperture or opening 122 aligned with the apertures in the remaining plate parts for receiving the tube 117. Three angularly spaced-apart keyway slots 124 are formed in the inner edge of each hub portion 119 and open into the central aperture 122 thereof. Three bar or rod-like keys 126 are fixed to the outer periphery of the tube 117 and extend longitudinally therealong to fit within aligned keyway slots 124 in adjacent hub portions 119, to prevent relative rotation between the plate parts 106 and the tube 117.

The hub portions 119 of the plate parts 106 are annular and uniform in thickness. The fingers 105 are integrally connected to, have the same thickness as, and extend substantially radially from respective hub portions 119. The fingers 105 are elongated and are generally rectangular in cross section throughout their lengths. Each finger 105 terminates in an end face 105A (FIG. 10), which is substantially perpendicular to the radially extending or longitudinal axis of the finger.

As best seen in FIG. 9, a bearing assembly 128 is disposed above the rotor cavity ceiling wall 64 and within the motor compartment 63 (FIG. 8) for mounting the rotor 51, and a like bearing assembly (not shown) serves to mount the rotor 50 in the same manner. The bearing assembly 128 includes a vertical main shaft 130, which has a lower flange 132 positioned below the wall 64 and fixed to an upper flange 134 on the neck portion 112 of the rotor 51 by bolts 136. A sheave 138 is fixed to the upper portion of the main shaft 130 and is driven by the belts 58.

A bearing housing 141 surrounds the intermediate portion of the main shaft 130 and has upper and lower bearing caps 143 and 145 secured thereto by a series of bolts. The lower bearing cap 145 fits into an annular shoulder or recess 147 in the ceiling wall 64, and extends into and through a hole 149 in the wall 64. An upper combination thrust and radial bearing 151 and a lower combination thrust and radial bearing 153 are spaced axially and journal the shaft 130 for rotation about a vertical axis within the bearing housing 141.

The bearings are lubricated, and a taconite seal arrangement generally indicated at 155 at the upper bearing cap 143 serves to retain the lubricant therewithin. A series of grease fittings 157, 159 and 162 enables the bearings to be properly lubricated. An exclusion seal 164 surrounds the lower portion of the shaft 130 at the lower bearing cap 145.

Discharge Doors

Considering now the discharge doors 41 and 43 in greater detail, as best seen in FIGS. 1, 3, 4, 5 and 6, the bottom door 43 is bowed and is complementary-shaped relative to the lower portion of the discharge opening 39. The bottom door 43 has a pair of parallel spaced-apart upwardly-extending swing arms 182 and 183 at the opposite sides thereof, the arms being pivotally attached at their upper ends to the hood 37 at 184 and 185, respectively. As a result, the bottom door 43 swings upwardly and outwardly from its closed position, as indicated in solid lines in FIG. 3, out of the plane of the opening 39 and about the pivot points 184 and 185 to an open position as shown in broken lines in FIG. 3. Similarly, the smaller top door 41 is bowed and is complementary-shaped relative to the opening 39. The top door 41 includes a transverse brace 186, and a pair of upwardly-extending parallel spaced-apart swing arms 187 and 188 which are pivotally attached at 189 and 190 to the hood 37 in horizontal alignment with the outer pivot points 184 and 185 for the bottom door 43. Thus, the top door 41 also swings between open and closed positions relative to the discharge opening 39.

In order to control the opening and closing of the bottom door 43, a piston and cylinder assembly 191 is pivotally attached at its upper, rear end at 192 to a support frame 193, a portion of which extends outwardly from the hood 37, to suspend the assembly 191 so as to extend downwardly from the support frame 193. The assembly 191 includes a piston rod 194, which is pivotally connected at 195 (FIG. 5) to an over-center locking device, generally indicated at 196.

Figure 4:
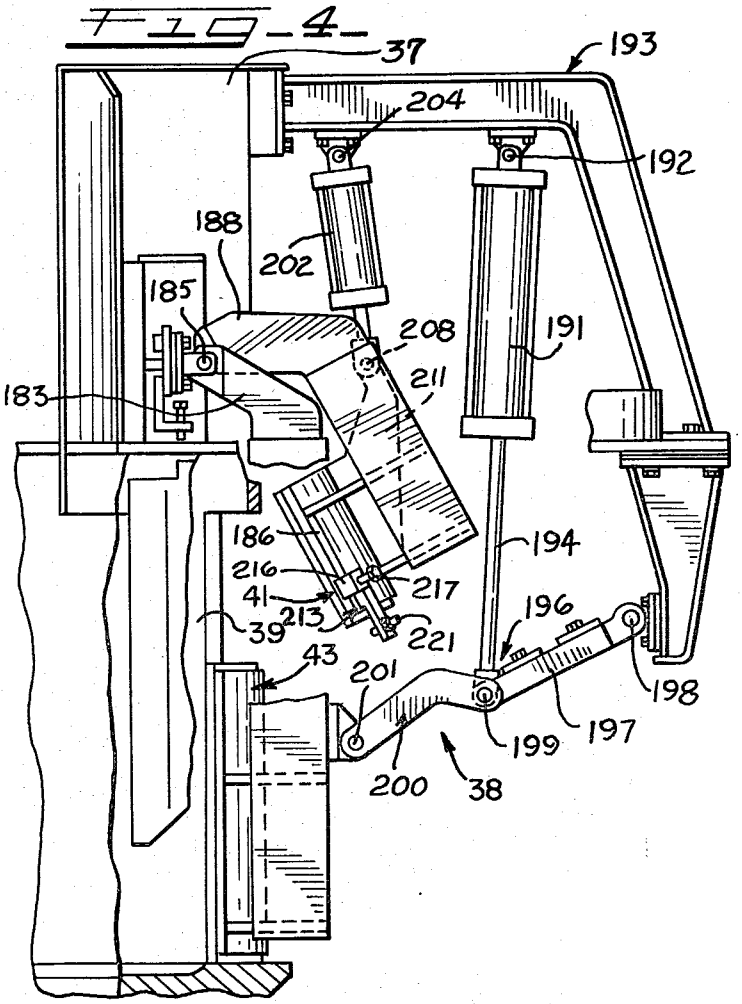
FIG. 4 is an enlarged fragmentary left end elevational view thereof, illustrating the top door in open position and the bottom door in closed position.
Figure 5:
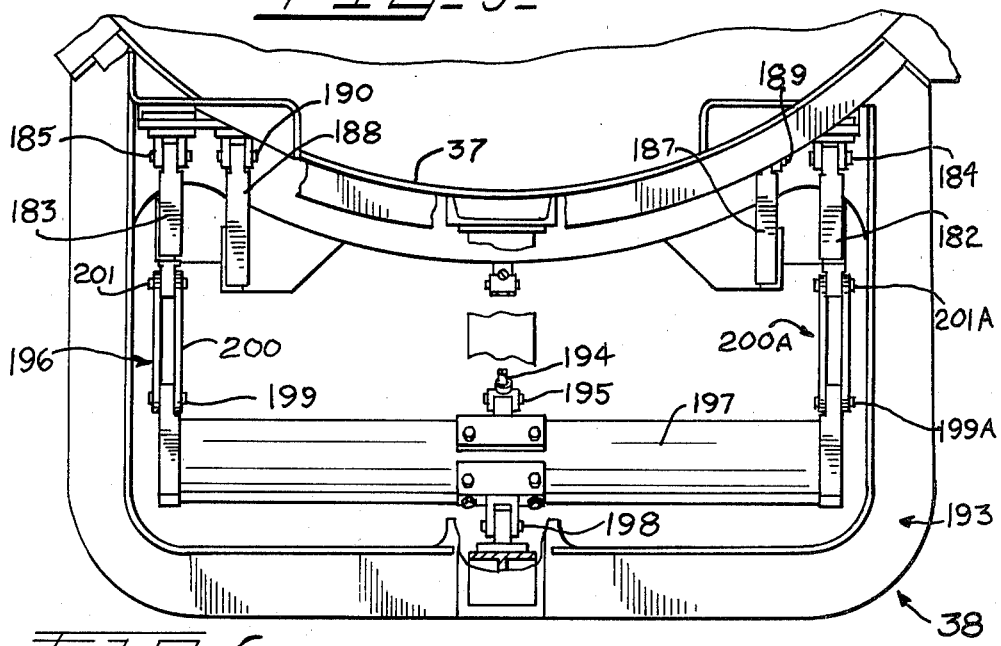
FIG. 5 is an enlarged fragmentary plan view thereof, illustrating the discharge doors in their closed positions.

The locking device 196 facilitates the closing of the large bottom door 43 and maintains it in its closed position. As best seen in FIG. 4, the locking device 196 includes a heavy transverse bar 197 which is spaced outwardly from the door 43 and is pivotally attached at 198 to a downwardly extending portion of the support frame 193. As best seen in FIG. 5, the outer ends of a pair of bent double-bar links 200 and 200A are pivotally attached to the bar 197 at pivot points 199 and 199A, and their inner ends are pivotally attached at 201 and 201A to the bottom door 43.

Figure 3:
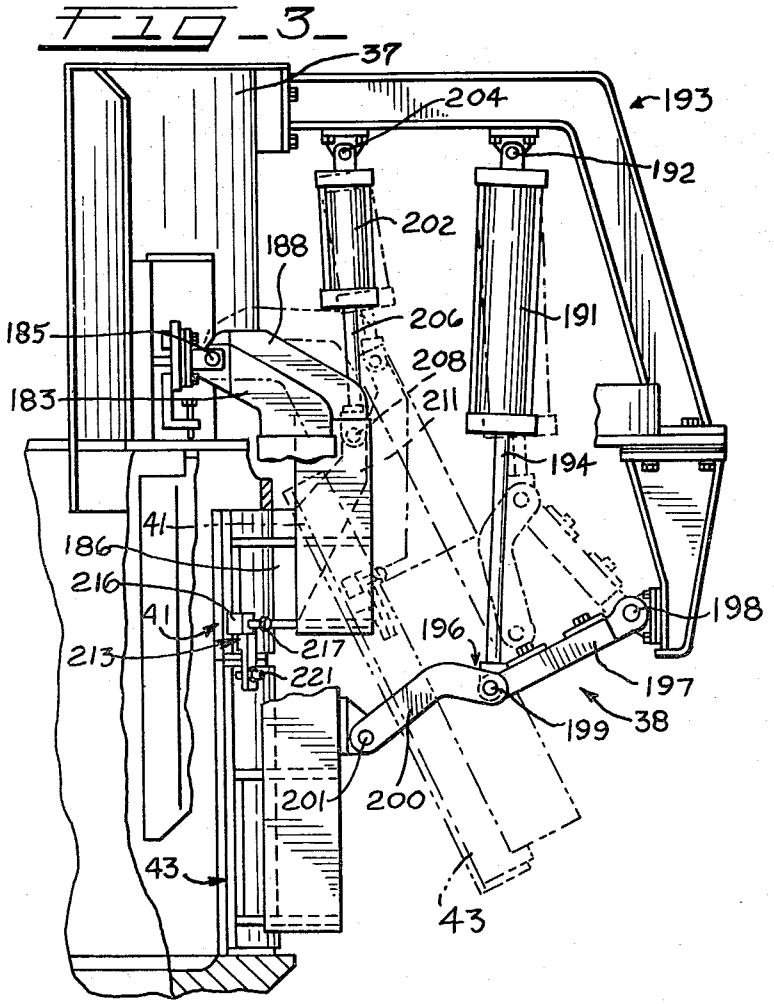
FIG. 3 is an enlarged fragmentary left end elevational view thereof, illustrating the discharge doors in their closed positions, the open positions of the doors being illustrated in broken lines.

As shown in FIGS. 3 and 4 in solid lines, when the piston rod 194 is extended, the locking device 196 swings the heavy bar 197 downwardly, helps move the bottom door 43 into its closed position, and helps keep the bottom closed. When the bottom door 43 is closed, the heavy bar 197 is inclined slightly downwardly from its outer pivotal connection 198, so that the bar 197 is disposed in substantial alignment with the bent double-bar links 200 and 200A. When the piston and cylinder assembly 191 retracts its piston rod 194, as indicated in broken lines in FIG. 3, the heavy bar 197 thereby is swung upwardly about its pivotal connection 198 and the bent double-bar links 200 and 200A are swung upwardly into upright positions for pulling the bottom door 43 into an open position about the pivot points 184 and 185.

Similarly, a short piston and cylinder assembly 202 is pivotally attached at its upper, rear end to a portion of the overhead support structure 193 at the pivot point 204 for opening and closing the top door 41. The piston and cylinder assembly 202 includes a reciprocatively mounted piston rod 206, which is pivotally attached at 208 to an upwardly extending centrally disposed arm 211, as best seen in FIG. 4. The lower end of the arm 211 is fixedly attached to the central portion of the door 41. The piston rod 206 is retracted to swing the top door 41 about the horizontal pivot points 189 and 190, in order to move the top door 41 from its closed position as shown in FIG. 4. In the open position, as hereinafter described in greater detail, the prepared material overflows the top edge of the closed bottom door 43, which then is in the position illustrated in FIGS. 4 and 15B.

The top door 41 also can be pivoted to its open position together with the bottom door 43 when it is pivoted to its open position, both as illustrated in FIG. 3 in broken lines. Referring to FIGS. 13, 4 and 15A–15C, for the purpose of causing both the top and bottom doors to move in unison upon the opening of the bottom door 43, two downwardly depending, spaced apart like arm units 213 and 215 are fixed to the bottom portion of the top door 41 and extend downwardly over the bottom door 43. When the top door is closed and the bottom door is pulled open by its piston rod 194, the upper portion of the bottom door 43 engages the units 213 and 215 (FIGS. 15A–15C) to pull the top door 41 into its open position in unison with the bottom door 43. The control circuit 44, as shown in FIG. 13 and described hereinafter, causes the piston and cylinder assembly 202 to be de-energized and thereby enable the piston rod 206 to be retracted when the top door is pulled open by the bottom door.

Referring to FIGS. 3, 4, 15A–15C, the arm unit 213 is representative of both units 213 and 215, and it generally comprises an L-shaped elongated block 216, which is fixed by a bolt 217 to the lower portion of the top door 41. An adjusting pin 221 extends through the lower free end portion of the block 216, to serve as an abutment when the bottom door 43 is pulled to its open position and the top door 41 is in its closed position. The upper portion of the bottom door 43 then engages the rearward end portion of the adjusting pin 221 to apply a lifting force to the arm unit 213 and thus to the top door 41.

Figure 15A:
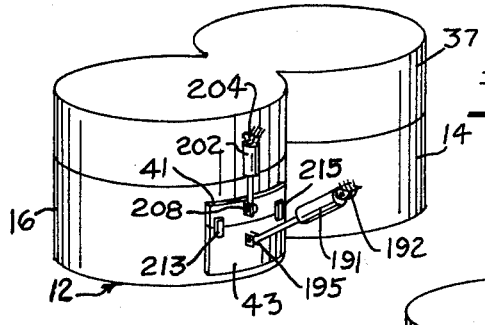
FIGS. 15A—15C are schematic diagrams of the mixing equipment of FIG. 1, respectively illustrating the discharge doors in successive different conditions.
Figure 15B:
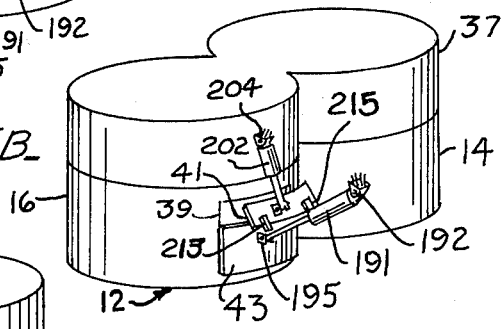
Figure 15C:
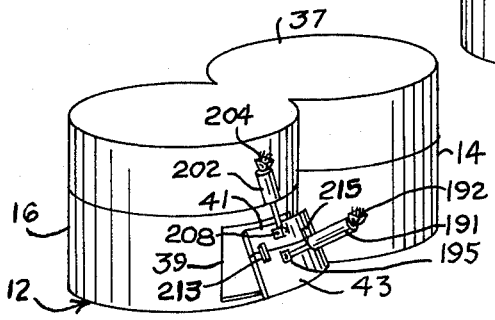

FIGS. 15A, 15B and 15C schematically illustrate the several positions of the doors 41 and 43. In FIG. 15A, both of the doors are closed, for dispersing or storing material within the mixing compartment 12. In FIG. 15B, the top door 41 is open and the bottom door 43 is closed, to permit prepared material to overflow the bottom door 43 for discharging prepared material. In FIG. 15C, both doors are open, both for facilitating the cleaning out of the interior of the compartment 12, and for relieving excess pressure build-up within the compartment, as described hereinafter.

Sensing Apparatus and Discharge Control Circuit

Figure 14A:
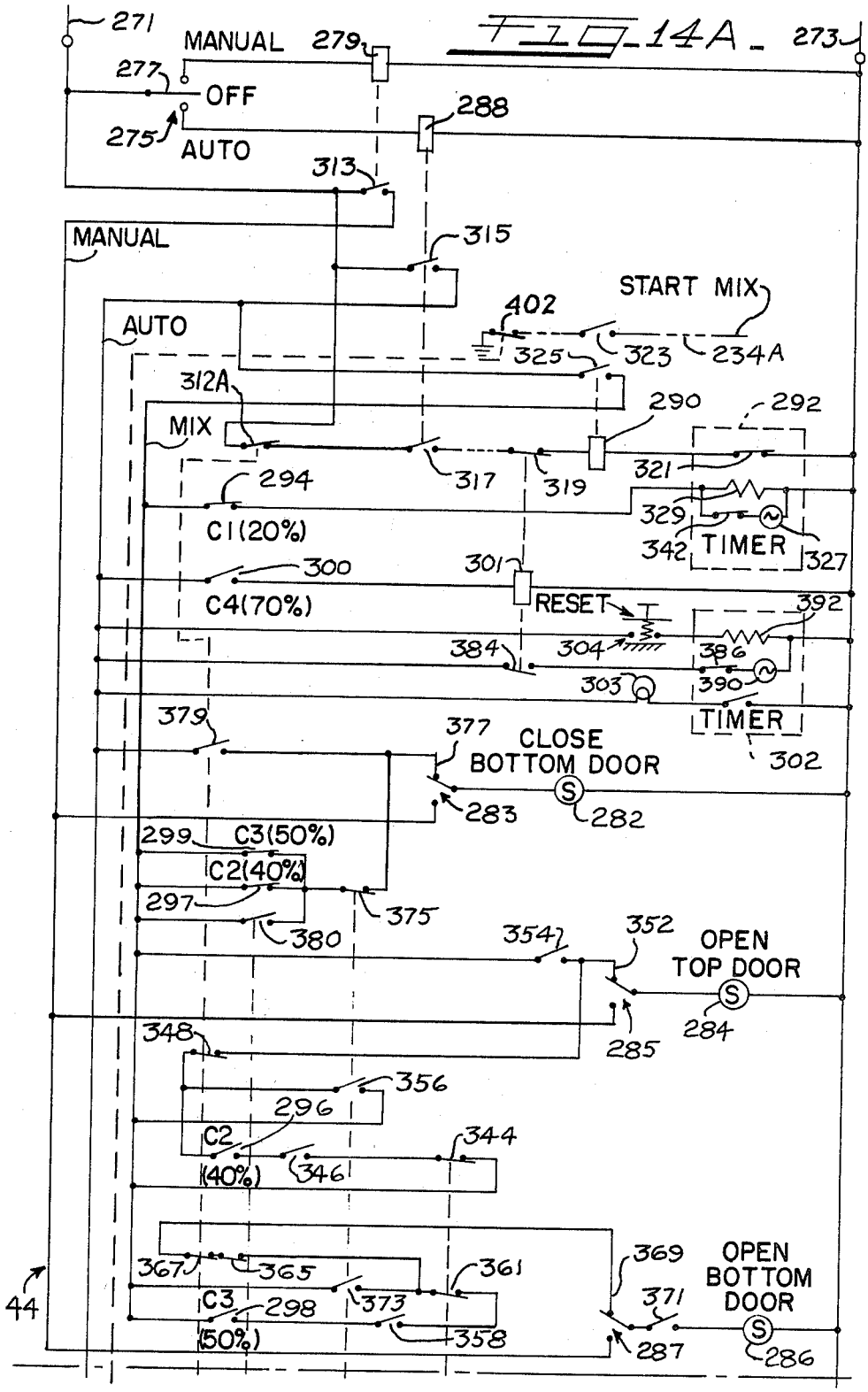
FIGS. 14A and 14B together constitute a schematic diagram of the control circuit represented in FIG. 13.
Figure 14B:
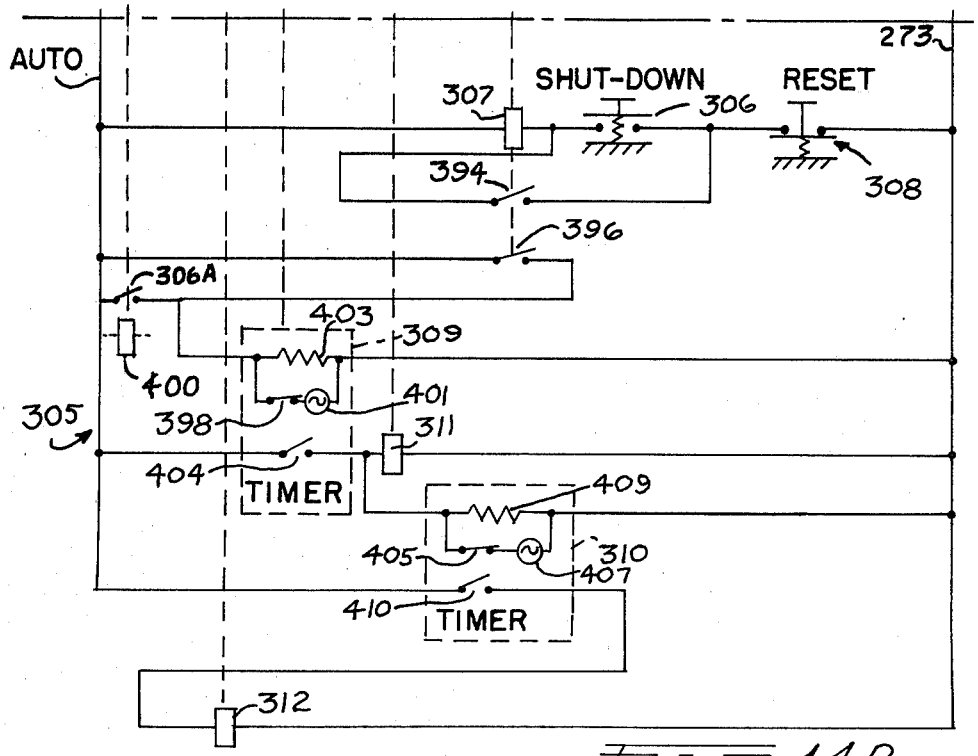

Considering now the control circuit 44 for the discharge doors 41 and 43, together with the power circuitry for the mixing component 12, with particular reference to FIGS. 13, 14A and 14B, three-phase power lines L1, L2 and L3 are connected through a pair of line controllers 231 and 233 to the respective drive motors 22 and 24 for the mixing compartment 12. A supply solenoid shown schematically at 234 in FIG. 13 controls the addition of the sand, binder and water to the mixing compartment. It is to be understood that the solenoid 234 is a symbolic representation of a plurality of such devices. A control lead 234A supplies a signal START MIX to the solenoid 234 for supplying ingredients to the mixing compartment 12, the lead 234A also being used for other control circuits (not shown).

In order to sense the consistency or stiffness of the material being mixed in the mixing compartment 12, a pair of power or watt meters 235 and 237 monitor the electrical load for the motor 24. Thus, as the consistency of the mixture increases in the mixing compartment 12, the motor 24 draws higher current loads which are detected by the load meters 235 and 237.

The load meter 235 has two set points 239 and 242, which generate signals C1 and C2, respectively, for the control circuit 44. The signal C1 indicates a low value of current and thus a relatively low consistency. For example, it will be assumed that the set point 239 is positioned at a point of 20% of the full or maximum load, and the set point 242 is set at a higher position to generate the signal C2 at 40% of the full load. Similarly, the load meter 237 is provided with two set points 244 and 246 for providing the signals C3 and C4, respectively, for the control circuit 44. The set point 244 is set at 60% of full load, and the set point 246 is set at 70% of the full load.

Considering now the manner in which the load meters 235 and 237 monitor current drawn by the motor 24 for the discharge bowl portion 16 of the mixing compartment 12, two power transformers 248 and 250 are connected across the leads 2T2 and 2T3 from the output of the line controller 233, for energizing the load meters 235 and 237, respectively. A pair of current-sensing arrangements generally indicated at 252 and 254 detect current in the line 2T3 connected between the output of the controller 233 and the motor 24 and supply an indication of such current flow to the respective meters 235 and 237.

The load meters 235 and 237 are provided with respective indicators 256 and 258 which rotate through a distance in proportion to the current flowing through the lead 273. The indicator 256 as it moves from left to right as viewed in FIG. 13 causes the set point 239 to close and then the set point 242 to close. Similarly, the needle 258 closes the set points 244 and 246 successively as the indicator 258 moves rightwardly as viewed in FIG. 13.

The load meter 235 includes a pair of manually operable set point control knobs 261 and 263 to adjust positionally the set points 239 and 242, so that different consistencies may be sensed for given material in the mixing compartment 12. Similarly, the load meter 237 has a pair of manually operable set point control knobs 265 and 267 which control the position of the set points 244 and 246.

A line transformer 269 has its primary winding connected across the input lines L1 and L2, and the secondary of the transformer 269 is connected to a pair of input lines 271 and 273 for the control circuit 44, for supplying power thereto.

Referring now to FIGS. 14A and 14B, the control circuit 44 can be operated either in a manual mode of operation or in an automatic mode of operation. For this purpose, a three-way manual switch 275 is employed, and it has a movable contact 277 which can be moved to an upper position, as illustrated for the manual mode of operation, and to a lower position for the automatic mode of operation, an intermediate position being the off position.

When the movable contact 277 is moved to the upper position, for the manual mode of operation, a relay 279 is operated to connect the input lead 271 to a lead designated MANUAL. A solenoid 282 is energized to supply air under pressure via conduits (not shown) to the bottom door air piston and cylinder assembly 191 for closing the bottom door 43, when a manual switch 283 is actuated to connect the solenoid 282 across the manual lead and the grounded lead 273. Similarly, a solenoid 284, when actuated, supplies air under pressure via conduits (not shown) to the small air piston and cylinder assembly 202 to cause it to open the top door 41, when a manual switch 285 is actuated to connect the solenoid 284 between the manual lead and the grounded lead 273. A solenoid 286 can be actuated manually to cause air under pressure to be supplied to the air piston and cylinder assembly 191 to move the large bottom door 43 to its open position, when a selector switch 287 connects the solenoid 286 across the manual lead and the grounded lead 273.

It is to be understood that while the solenoids 282, 284 and 286 are shown schematically in the drawings, the solenoids 282 and 286 are portions of a two-position, four-way double solenoid valve (not shown), and the solenoid 286 is a portion of a two-position, four-way single-solenoid spring return valve (not shown). The last-mentioned valve controls the opening and closing of the top door 41 with only a single solenoid 284.

The top door 41 can be opened at any time during the manual mode of operation by actuating the switch 285. In order to close the top door manually, switch 285 may be actuated to disconnect the solenoid 284 from the manual lead and thereby de-energize the solenoid 284 due to the spring return feature of its valve (not shown), whereupon the piston and cylinder assembly 202 moves the door 41 back to its retracted position. Also, during the manual mode of operation, the bottom door 43 can be opened or closed by operating either the solenoid 286 or the solenoid 282, respectively.

During the automatic mode of operation, the movable contact 277 of the switch 275 is disposed at the lower position to connect a relay 288 between the leads 271 and 273. When the relay 288 operates, it connects the AUTO lead to the input lead 271. A relay 290 also is caused to be operated in response to the operation of the relay 288, for closing its contacts 323 and 325 to connect the power lead 271 through the now closed contacts 315 of the relay 288 to the MIX lead, and to cause the signal START MIX to be sent via the lead 234A to the ingredient supply solenoid 234 (FIG. 13) for the purpose of supplying ingredients to the mixing compartment 12, and causing a timer 292 to be started.

The timer 292 is on-delay timer and is started when the lead MIX thereby is connected through the normally closed switch 294 to the power lead 271. The switch 294 corresponds to the set point 239 acutated by the indicator 256 of the load meter 235, as shown in FIG. 13. In this regard, while a switch 294 is shown schematically, it is well known to those skilled in the art that when the set point 239 closes, one or more relays (not shown) are operated to cause the switch 294 to open in the control circuit 44.

When the timer 292 reaches the conclusion of its time interval, the relay 290 is restored, to stop the supply of ingredients to the mixing compartment 12. Thus, the timer 292 is interrupted from completing its counting operation once the switch 294 opens, whereby the START MIX signal via lead 234A remains energized. As a result, if the prepared material does not become sufficiently stiff in its consistency prior to the expiration of the time delay interval for the timer 292, the timer 292 opens the circuit to the relay 290 for removing the signal START MIX thereby to terminate the supply of ingredients to the mixing compartment 12.

A normally-open set point contact 296 is closed when the set point 242 is closed when the consistency of the prepared material exceeds 40% of the reading of the meter 235 for causing the solenoid 284 to open the top door 41. Thus, once the consistency of the prepared material exceeds an initial predetermined value of consistency, the top door 41 opens to permit prepared material to discharge over the bottom door 43.

It should be noted that a normally closed switch 297 is controlled by the set point 242 and opens when the consistency of the material exceeds the 40% meter reading, and thus the switch 297 opens when the set point 242 is actuated by the indicator 256 to de-energize the solenoid 282 when the switch 299 opens subsequently, so that the bottom door 43 can be subsequently opened by actuating the solenoid 286. Similarly, a normally closed switch 299 is controlled by the set point 244 of the meter 237, so that below the 50% reading of the meter 237, the bottom door solenoid 282 maintains the bottom door 43 in its closed position. A normally open contact 298 is closed on the actuation of the 50% set point 244 to cause the solenoid 284 to be energized for opening the top door 41. A normally closed switch 299 is connected redundantly in parallel with the switch 297, and opens when the 50% set point 244 is actuated for the purpose of insuring that the solenoid 282 becomes deactivated so that the solenoid 286 can cause the bottom door to become opened. The redundant design insures that the bottom door remains closed up to at least 40% of the full scale reading.

A set of normally opened contacts 300 close when the set point 246 of the meter 237 closes to operate a relay 301, thereby starting a timer 302. In this regard, the switch 300 is closed when the consistency of the prepared material produces a reading in excess of 70% of full scale on the meter 237, both the bottom and top doors then having been opened to relieve an undesired build-up of pressure in the mixing compartment 12. If the pressure is not reduced within the time delay interval of the timer 302, it energizes a signal light 303 to indicate the existence of the excessive load so that personnel can be alerted to the problem, whereby the manual mode of operation can be entered to correct the situation. Once the light 303 is energized, the attendant can extinguish it by resetting the timer 302 by means of a manual momentary contact switch 304.

Referring now to FIG. 14B, the control circuit 44 includes a shutdown control circuit portion generally indicated at 305, which enables the mixing equipment 10 to be shut down automatically through an orderly sequence of operations. The circuit 44 enables the mixing equipment 10 to be ready to commence discharging, without any unwanted delays, following an interruption of the continuous operation. The continuous mode of operation of the mixing equipment 10 can be interrupted, either manually or automatically. In the automatic shutdown operation, either an interruption of the supply of one or more of the ingredients, or a lack of downstream demand, causes the commencement of a shutdown cycle of operation. Once the condition causing the interruption changes, it is highly desirable to resume operation without delay.

However, the operation should not commence immediately since the material left in the mixing compartment requires processing before discharging it. Therefore, once an automatically initiated shut down operation is called for, the supply of ingredients terminate and both doors are then closed for a predetermined retention time interval. During that time interval, the material continues to be mixed within the mixing compartment 12 so that it will be thoroughly mixed and ready for discharge without delay. Once the continuous mode of operation is again called for by the mixing equipment 10, as a result of either the supply of ingredients now functioning properly, or the downstream demand resuming, the top door opens under the control of the circuit 44 to commence continuous overflow operation; provided, however, that the retention time interval has not expired.

In the situation where the retention time interval terminates prior to calling for a return to the continuous operation, the circuit 44 causes both of the doors 41 and 43 to open for a predetermined discharge time for discharging rapidly at least a portion of the contents of the mixing compartment 12. In this regard, it is important to limit the length of time that mixing of the materials takes place, otherwise the retained batch of expensive prepared materials would be mulled for an excessive amount of time and thus be ruined or otherwise improperly conditioned. Thus, at least a major portion of the load prepared materials is discharged following the retention time interval, while it is still properly mulled.

A limit switch (not shown) for the hopper 45 (FIG. 1) is positioned on the hopper to provide a "full" indication to the control circuit for causing a relay 400 (FIG. 14B) to operate when the discharge hopper 45 is filled to a certain predetermined high level. Thus, the "full indication" signifies a lack of downstream demand, thereby triggering the shutdown operation automatically. If the downstream demand does not resume prior to the end of the retention time period, the retained prepared material, or at least a substantial portion of it, is then dumped into the hopper 45 and occupies the space within the hopper above the high level limit switch. Thus, the limit switch is positioned to enable the hopper 45 to receive the additional load during such an automatic shutdown mode of operation, as well as during a manual shutdown operation which occurs, for example, at the end of a work day. In this manner, the prepared material is stored in the discharge hopper and not in the mixing equipment 10.

It should be understood that in a manually initiated shutdown operation, the ingredient supply is terminated and the material is retained for mixing, but the material is always retained for the full retention interval and the continuous mode of operation is never commenced prior to the end of the retention period of time during the manual shutdown operation.

The shutdown control circuit portion 305 indicates a manual switch 306, which, when operated, operates a relay 307 to initiate manually the shutdown cycle of operation. A momentary contact switch 308, when actuated, releases the relay 307 following the shutdown cycle of operation. The circuit portion 305 also includes a relay-operated normally open contact 306A, which when closed, initiates the automatic shutdown cycle of operation in response to either an interruption in the supply of ingredients, or a lack of downstream demand.

In order to retain material in the mixing compartment 12, a retention timer 309 is started upon operation of the relay 307 or the closure of contacts 306A, to cause the closing of the bottom door 43 and thus the closing of the top door 41. Thereafter, the supply of ingredients is discontinued to permit thorough mixing of the material within the compartment 12. At the conclusion of the time retention interval determined by the retention timer 309, a discharge timer 310 is started, and a relay 311 is operated to cause both the top door 41 and the bottom door 43 to be opened for discharging prepared material from the mixing compartment 12. A relay 312 is operated at the termination of the time delay interval of the discharge timer 310 to enable the doors to return to their closed positions, and to open the circuit to the CLOSE BOTTOM DOOR solenoid 282. Normally closed contacts 312A of the relay 312 open to restore the relay 290, thereby terminating the signals MIX and START MIX. Thus, the shutdown cycle of operation is completed. As a result, the production of material is shut down with the mixing compartment 12 empty, or nearly empty, and ready to resume operation, when desired.

Referring to FIG. 14A, the control circuit 44 will now be considered in greater detail. The relay 279 includes contacts 313 for connecting the power lead 271 to the manual lead. Similarly, the relay 288 includes contacts 315 for connecting the power lead 271 to the AUTO lead. The relay 288 also includes contacts 317 for connecting the power lead 271 through the normally closed contacts 319 of the relay 310 to the relay 290, which in turn is connected through the normally closed contacts 321 of the timer 292, to the grounded power lead 273.

Thus, the relay 288 operates and establishes a current path from the lead 271 through the contacts 317 and 319 to the relay 290 and from there through the contacts 321 to the grounded lead 273. Once the relay 290 operates, it closes a pair of contacts 323 to cause the signal START MIX to be generated and to be supplied via the lead 234A to the solenoid 234 (FIG. 13), to commence the supply of materials to the mixing compartment 13. The supply of materials is terminated by restoring the relay 290, either by having the on-delay timer 292 complete its timing interval, or by causing the relay 301 to operate when the set-point switch 300 closes. The switch 300 closes upon activation of the set points 246 of the meter 237, due to high material consistency. Relay contacts 325, when closed, contact the AUTO lead to the MIX lead, so that both the AUTO lead and the MIX lead are connected to the power lead 271 when the automatic mode of operation is selected by positioning the movable contact of the selector switch 275 to its lower position.

Considering now the timer 292 in greater detail, the on-delay timer 292 is set for a suitable time delay interval, such as five minutes, within which the consistency of the material being dispersed within the compartment 12 should exceed the initial desired consistency. However, it will become apparent to those skilled in the art that other time intervals may be selected for particular applications. The timer 292 includes a motor 327 which is energized in series with a clutch coil 329 via a pair of normally-closed contacts 342 connected in series with the motor 327. Thus, once the MIX lead is connected to the power lead 271 upon selecting the automatic mode of operation, power is supplied through the normally closed contacts 294 to the motor 327 via the contacts 342. The motor 327 is a timing motor which continues to run for the initial time delay interval, upon the termination of which the contacts 321 open to restore the relay 290, thereby terminating the supply of ingredients by removing the signal START MIX. However, if the normally closed 20% set point switch 294 opens prior to the termination of the initial time delay interval of the timer 292, the timer 292 resets itself and the contacts 321 remain closed, thereby maintaining the relay 290 operated for continuing to generate the signal START MIX. Thus, the supply of ingredients continues, unless switch 294 does not open prior to the termination of the time interval of the timer 292. If the switch 294 does open prior to the termination of the time interval of the timer 292, the supply of ingredients is terminated, since an equipment malfunction of some type has occurred.

Considering now the actuation of the solenoid 284 for opening the top door 43, a current path extends from the MIX lead through normally closed contacts 344 of the relay 307, normally-open switch contacts 346, controlled by the "high level" limit switch (not shown) for indicating when closed that there is space available to receive the discharged prepared materials, the 40% set point contacts 296, contacts 348 of the relay 312, and the upper terminal 352 of the selector 285 to the solenoid 284. Thus, once the consistency of the mixture becomes sufficiently stiff to cause the closing of the 40% contacts 296 and the switches 346 and 350 close, the solenoid 284 operates. Normally open limit switch contacts 354 are open when the bottom door 43 is closed. When the door 43 opens, the contacts 354 close, to connect the MIX lead to the upper terminal 352 of the selector switch 285 and energize the solenoid 284. In this regard, when the bottom door 43 moves open, it causes the top door 41 to open. In order to protect the air piston and cylinder assembly 202 for the top door 41, the contacts 354 activate the solenoid 284, thereby opening the top door 41 by means of the piston and cylinder assembly 202.

Upon the completion of the retention time delay interval produced by the retention timer 309, when closed, contacts 356 of the relay 311 establish another current path to the solenoid 284 for opening the top door 41. In this regard, when the contacts 356 close, a current path is established from the MIX lead through the contacts 356, the contacts 348, the upper terminal 352 of the selector switch 385, and the solenoid 284.

In order to energize the solenoid 286 for opening the bottom door 43, a current path is established between the MIX lead through the 50% set-point contacts 298, switch contacts 358, controlled by the "high level" limit switch (not shown) for indicating when closed that there is storage room available for accepting additional prepared material, the normally closed contacts 361 of the relay 307, the normally closed contacts 367 of the relay 312, the upper terminal 369 of the selector switch 287 through a normally open limit switch contacts 371 indicating, when closed, that the top door is in its open position, and the solenoid 286. When closed, the normally-open contacts 373 of the relay 311, following the retention time delay interval, override the contacts 298, 358 and 361 to help complete the shutdown cycle of operation, by activating the solenoid 286 to close the bottom door 43 for discharging prepared material. It should be noted that both doors are opened at the completion of the retention interval.

In order to energize the solenoid 282 to cause the piston and cylinder assembly 191 to close the bottom door 43, a current path is established through the normally closed 40% set point contacts 297, normally closed contacts 375 of the relay 311 and the upper terminal 377 of the selector switch 283. The solenoid 282 also is energized to close the bottom door 43 when the normally open contacts 379 of the relay 312 close at the completion of the discharge time delay interval, thereby connecting the MIX lead to the upper terminal 377 of the selector switch 283.

Alternatively, the solenoid 282 is energized when the contacts 380 of the timer 309 are closed when the timer 309 is started at the beginning of the retention interval, to establish a current path from the lead MIX through the normally closed contacts 375 of the relay 311, the selector switch 283, and the solenoid 282. As a result, the bottom door 43 closes, thereby closing mechanically the top door 41.

A pair of normally open contacts 384 of the relay 301 provide, when closed, a current path between the AUTO lead and the timing motor 390 of the timer 302 via its normally closed contacts 386. When the relay 301 operates upon the occurrence of an excessively heavy load, the relay contacts 384 close to start the timer 302 by energizing the motor 390. A clutch coil 392 is connected between the reset switch 304 and the grounded lead 273, in parallel with the series combination of the contacts 386 and the motor 390.

Referring now to FIG. 14B of the drawings, normally open contacts 394 of the relay 307 are latching contacts therefor. Once the relay 307 operates via the manual switch 306, it is maintained operational by a path from the AUTO lead through the contacts 394. Normally open contacts 396 of the relay 307 close, when the relay 307 is operated, to provide a current path from the AUTO lead through the normally closed contacts 398 of the retention timer 309 to a timing motor 401.

Similarly, the normally open contacts 306A, connected in parallel with the contacts 396, are closed when at least one of the supply of ingredients is interrupted or the downstream demand ceases. Closing of contacts 306A of a relay 400 causes the retention timer 309, and the relay 400 opens its contacts 402 (FIG. 14A) to remove the ground potential from the START MIX lead to stop the supply of ingredients to the mixing chamber 12.

The switch 398 and the motor 401 are connected in parallel with a clutch coil 403, the parallel combination thereof being connected to the grounded terminal 273. Thus, when the contacts 396 or 306A close, the motor 41 is energized for a predetermined time delay interval, after which normally open relay contacts 404 are closed in series with the relay 311 to cause it to operate.

In the automatic mode of operation, when the contacts 306A close, should the conditions causing the closing of the contacts 306A change or be corrected before the completion of the retention time interval, the relay 400 restores and opens its contacts 306A, thus causing the on-delay timer 309 to reset itself and the START MIX lead is re-connected to ground when relay 400 restores its contacts 402.

Should the timer 309 time out, the contacts 404 close and a circuit is connected between the AUTO lead through normally closed contacts 405 of the timer 310 to the timing motor 407, to commence the time delay interval. A clutch coil 409 is connected in parallel with the series combination of the switch 405 and the motor 407. At the conclusion of the time delay interval for the timer 310, the normally-open contacts 410 of the timer 310 close to connect the relay 312 across the leads AUTO and 273.

Additional Rotor Embodiments

Referring to FIG. 16, there is shown a second plate part 411 for an agitator rotor (not shown) in accordance with the present invention, otherwise constructed and arranged like the above-described rotors 50 and 51. The second plate part 411 includes a plurality of fingers like the illustrative finger 413, each of which extends radially outwardly and terminates in a pair of outwardly convergent intersecting end faces 414 and 415. The second plate part 411 otherwise is constructed like the first plate part 411. The end faces 414 and 415 of the fingers 413 afford less resistance as they move through the stream of granular material, as compared to the squared end edges of the fingers 105 of the first plate part, which present flat side edges as they move into engagement with the material. Consequently, the end faces 414 and 415 of the finger 413 reduce the load on the motor driving a rotor constructed with a plurality of the second plate parts 411.

Referring to FIG. 17, there is shown a third plate part 417, which is constructed in accordance with the present invention. The third plate part 417 is like the first and second plate parts 106 and 411, but includes fingers 419 each extending radially outwardly and terminating in an end face 422, which face extends at an acute angle to the radial or longitudinal axis of the finger. The plate part of FIG. 17 rotates in a clockwise direction, and since the angle of the face 422 relative to the finger axis is a greater angle than the corresponding angles of the end faces 414 and 415 of the second plate part 411, the finger 419 presents less resistance as it moves through the stream of material. As a result, the third plate part 417 affords even less resistance to movement through the material to be agitated than the second plate part 411, and less electrical power is required to drive a rotor constructed with a plurality of the third plate parts 417.

Therefore, it will become apparent to those skilled in the art that in order to afford a smaller amount of resistance to the movement of a plate part through the material to be agitated, the ends of the fingers of plate part preferably are bevelled to provide inclined faces. On the other hand, in order to provide a greater amount of agitation, the ends of the fingers are bevelled at smaller angles or are squared.

Referring to FIG. 18, a modified rotor 424 constituting a further embodiment is mounted on the bearing assembly 128 illustrated more completely in FIG. 9, in place of the rotor 51 illustrated in such view. The modified rotor 424 is generally similar to the first-described rotors 50 and 51, except that the modified rotor can be adjusted. The modified rotor 424 includes a generally cylindrical hub 426 which has a plurality of fingers 428 extending radially outwardly therefrom, similarly to the manner in which the fingers 105 extend outwardly from the first-described rotor 51. A neck 430 extends upwardly from the hub 426 for connection to the bearing assembly 128.

The hub 426 of the modified rotor 424 includes a tube 432 which is rigid throughout its length. A top plate 434 is fixed to the upper end portion of the tube 432 and fits within an annular shoulder 435 thereof. A removable centrally apertured bottom plate 436 fits within an internal annular shoulder 437 at the bottom end of the tube 432. A threaded rod 438 extends through the aperture of the bottom plate 436, and it has an upper threaded end 439 secured in an axially extending tapped hole 441 in the bottom face of the neck portion 430. A washer 442 for the threaded rod 438 is positioned on the bottom face of the bottom plate 436.

Each one of the fingers 428 on the modified rotor 424 includes a non-circular block-like stud 443 which is generally rectangular in shape and terminates in an outer flat rectangular face 444 perpendicular to the radial or longitudinal axis of the stud. The outer face 444 is oriented as shown in FIG. 18 of the drawings, to assume a diamond configuration when viewed in elevation. As a result, when the rotor 424 revolves about its vertical axis, a wedge-shaped surface extending along the radially extending edges 446 of the studs 443 moves into the path of travel of and confronts the material to be agitated. As a result, less resistance to the movement of the rotor 424 is created by the material.

In order to enable the orientation of the fingers 428 to be adjusted, each finger 428 is provided with a base or shank 448 integral with its stud 443, and each shank 448 is threaded into a complementary tapped radial hole in the tube 432. Consequently, each finger 428 can be rotated about its radially extending axis to present different surfaces for engaging the material to be agitated. Thus, some or all of the fingers 428 readily can be adjusted angularly with respect to the hub 426. They can all be in the same position, such as shown in FIG. 18 of the drawings, or one or more of them can be rotated to an adjusted position for accommodating different types and kinds of material to be agitated.

In the different forms of the rotors disclosed herein, the impacting fingers are relatively short in their radially extending length as compared to the diameter of the hub. As a result, the impacting fingers are not subjected to unduly large bending moments caused by the resistance of the dispersed material. Dispersed material collects behind the rotor in the rotor cavity to present substantial resistance to the rotation of the rotor fingers therethrough. Moreover, by employing relatively short fingers, the hub is spaced by only a short distance away from the cavity wall so that only a small mount of material collects in that space and thus affords less resistance to the rotor fingers rotating therethrough.

While the particular embodiments of the invention have been described and illustrated, it will be understood by those skilled in the art that various changes and modifications may be made within the spirit and scope of the invention. It is intended that all such changes and modifications be included within the scope of the appended claims.

We claim:

1. In mixing equipment including a mixing compartment, means for supplying material to be mixed to the mixing compartment; and at least one mulling assembly rotatably driven about an upright axis within the compartment for dispersing within the compartment material, including granular material, the mulling assembly producing a rolling and rotating torus of the granular material mixture, apparatus for agitating the dispersed material and for discharging prepared material from the mixing compartment, said apparatus comprising:

means defining a discharge opening in a side wall of the mixing compartment;

door means mounted for movement between open and closed positions relative to said opening;

means including an upright wall defining a rotor cavity opening into said mixing compartment at a location spaced from said discharge opening;

an agitator having a rotor mounted for rotation about an upright longitudinal axis thereof disposed within said cavity, said rotor including a plurality of impacting fingers extending laterally from said rotor axis; and motive means for rotating said rotor about said rotor axis;

said rotor being mounted with respect to the wall of the rotor cavity and being adapted with said motive means to exert a force exceeding the resistance to its rotation afforded by the material therearound; and said fingers being adapted to extend outwardly from said cavity and into said mixing compartment as the rotor is rotated, for impacting material being dispersed within the compartment;

means for sensing the consistency of the material being dispersed;

means responsive to said sensing means for opening said door means at a predetermined first consistency, thereby to permit prepared material to overflow the bottom of said opening for discharge from the mixing compartment;

means for closing said door means and for causing the termination of the supply of material to be mixed to said mixing compartment to commence a shutdown cycle of operation during which material is retained within the mixing compartment;

retention timing means for causing material to be dispersed in the mixing compartment for a predetermined period of time, and subsequently for opening said door means while continuing to disperse material in said mixing compartment, to discharge the retained material from the mixing compartment; and discharge timing means for discontinuing said dispersing of material in said mixing compartment following the discharge of material, whereby the production of material is shut down with the mixing compartment at least partially empty of prepared material.

2. Mixing equipment according to claim 1, wherein said door means includes a pair of top and bottom doors adapted to move between open and closed positions relative to said opening, said top door being disposed contiguously above said bottom door in their closed positions, said retention timing means causing both of said doors to be closed for the retention of material within the mixing compartment.

3. Mixing equipment according to claim 2, further including means responsive to said sensing means for opening both of said doors at a predetermined second consistency of the dispersed material in excess of said first consistency, and means responsive to said sensing means for closing said bottom door when the consistency of the dispersed material falls below said second consistency.

4. In mixing equipment including a mixing compartment, and at least one mulling assembly rotatably driven about an upright axis within the compartment for dispersing within the compartment material, including granular material, the mulling assembly producing a rolling and rotating torus of the granular material mixture, agitating apparatus comprising:

means including an upright wall defining a rotor cavity opening into said mixing compartment;

an agitator having a rotor mounted for rotation about an upright longitudinal axis thereof disposed within said cavity, said rotor including a plurality of impacting fingers extending laterally from said rotor axis; and motive means for rotating said rotor about said rotor axis;

said rotor being mounted with respect to the wall of the rotor cavity and being adapted with said motive means to exert a force exceeding the resistance to its rotation afforded by the material therearound; and said fingers being adapted to extend outwardly from said cavity and into said mixing compartment as the rotor is rotated, for impacting material being dispersed within the compartment.

5. Mixing apparatus according to claim 4, wherein said rotor includes a hub having a substantially imperforate and smooth outer peripheral surface encompassing it therearound and from which said fingers extend.

6. Mixing apparatus according to claim 5, wherein said rotor cavity wall has a curved contour generally complementary in shape to the shape of the confronting portion of said hub, and said fingers extend to points closely adjacent to and substantially equidistantly spaced from the wall.

7. In mixing equipment including a mixing compartment, said compartment including a pair of side-by-side, generally cup-shaped bowl portions communicating at a common opening in side walls thereof, and a pair of mulling assemblies rotatably driven about upright axes within the respective bowl portions for dispersing within the mixing compartment material, including granular material, each one of the assemblies producing a rolling and rotating torus of the material dispersion and causing an interchange of dispersed material between bowl portions via the common opening, agitating apparatus comprising;

at least one means including an upright wall defining a rotor cavity which opens into said mixing compartment and which is disposed at one side of said common opening;

an agitator having a rotor mounted for rotation about an upright longitudinal axis thereof disposed within said cavity, said rotor including a plurality of impacting fingers extending laterally from said rotor axis; and motive means for rotating said rotor about said rotor axis;

said rotor being mounted with respect to the wall of the rotor cavity and being adapted with said motive means to exert a force exceeding the resistance to its rotation afforded by the material therearound; and said fingers being adapted to extend outwardly from said cavity and into said mixing compartment as the rotor is rotated, for impacting material undergoing said interchange between bowl portions.

8. Mixing apparatus according to claim 7, wherein said rotor includes a hub having a substantially imperforate and smooth outer peripheral surface encompassing it therearound and from which said fingers extend.

9. Mixing apparatus according to claim 8, wherein said fingers are arranged in axially extending rows substantially equidistantly spaced apart about said hub, the fingers in each row being axially spaced apart and the fingers in adjacent rows being axially staggered with respect to the fingers in adjacent rows.

10. Mixing apparatus according to claim 8, wherein said hub is formed by a stack of a plurality of plate parts, each one of said plate parts comprising a hub portion having a plurality of said fingers extending therefrom, and said rotor includes retaining means for fixedly securing said plate parts tightly together.

11. Mixing apparatus according to claim 10, wherein each one of said plate parts includes an internal aperture aligned with the apertures of the remaining plate parts, and said retaining means includes top and bottom members and a rod extending through the aligned plate apertures, said rod being fixedly secured at its ends to said top and bottom members.

12. Mixing apparatus according to claim 11, wherein said hub includes an internal tube extending through the internal apertures of each one of said plate parts, at least one external key member disposed on said tube, each one of said plate parts having a keyway slot opening into its internal aperture for receiving said key member.

13. Mixing apparatus according to claim 10, wherein the hub portions of said plate parts are annular and uniform in thickness, and said fingers are integrally connected to, have the same thickness as, and extend substantially radially from respective hub portions, and are generally rectangular in cross section.

14. Mixing apparatus according to claim 13, wherein at least some of said fingers terminate in an end face which is substantially perpendicular to the radial axis of the fingers.

15. Mixing apparatus according to claim 13, wherein at least some of said fingers terminate in an end face which extends at an acute angle to the radial axis of the finger.

16. Mixing apparatus according to claim 13, wherein at least some of said fingers terminate in a pair of outwardly convergent intersecting end faces.

17. Mixing apparatus according to claim 8, wherein said hub includes a generally cylindrical member, and each one of said fingers comprises a polygonal stud extending radially from said member, and including means rotatably connecting the stubs to said member for adjusting the angular dispositions of the studs relative to the member.

18. Mixing apparatus according to claim 17, wherein said connecting means comprises interengaging thread means on said studs and said member respectively for adjusting said stud dispositions individually.

19. In a method of producing prepared material, including granular material, in a mixing compartment including a pair of side-by-side, generally cup-shaped bowl portions communicating at a common opening in side walls thereof, wherein the material in each bowl portion is dispersed in a rolling torus rotating about an upright axis in the same direction as the torus in the other bowl portion, and a stream of material flows from each bowl portion through said common opening into the other bowl portion thereby to interchange material between the bowl portions, said streams flowing through opposite sides of the opening and oppositely to each other, the improvement wherein at least one of said streams is subjected to the mixing action of a rotor rotating about an upright longitudinal axis adjacent to the side of the opening through which the stream is flowing, said rotor including a hub and a plurality of impacting fingers extending laterally from the hub, said fingers when rotating on one side of said hub then extending into the adjacent stream with their outer peripheries moving cocurrently with and at a greater tangential rate of travel than such stream, thereby to impact on the material in the flowing stream for mixing and aerating the material.

20. A method according to claim 19, wherein the torus providing the stream being subjected to the mixing action is dispersed by a mulling assembly rotating about an upright axis in one of said bowl portions, said mulling assembly having material elevating plows spaced about the periphery thereof for dispersing the material in the rolling torus and having a plurality of mulling wheels journaled for rotation about individual upright axes spaced about the periphery for mulling the material against the side wall of the mixing compartment, said rotor depending downwardly into its stream and terminating at a position above said plows.

21. An agitator for use in mixing equipment, which equipment includes a mixing compartment, a mulling assembly rotatably mounted within the compartment for dispersing therein material, including granular material, and means including an upright wall defining a rotor cavity which opens into the compartment, said agitator comprising:

a rotor adapted for being mounted for rotation about an upright longitudinal axis thereof disposed within such a cavity, said rotor including:

(a) a hub having a substantially imperforate and smooth outer peripheral surface encompassing it therearound; and (b) a plurality of impacting fingers extending laterally from said hub surface therearound;

said rotor being adapted for being mounted with respect to such wall defining the cavity and for being rotated by motive means to exert a force exceeding the resistance to its rotation afforded by such material therearound; and said fingers being adapted to extend outwardly from such a cavity and into such compartment in turn as the rotor is rotated, for impacting material dispersed in the compartment.

22. An agitator according to claim 21, wherein said hub includes a stack of a plurality of plate parts, each one of said plate parts comprising a hub portion having a plurality of said fingers extending therefrom, and said rotor includes retaining means for fixedly securing said plate parts tightly together.

23. An agitator according to claim 22, wherein each one of said plate parts includes an internal aperture aligned with the apertures of the remaining plate parts, and said retaining means includes top and bottom members and a rod extending through the aligned plate part apertures, said rod being fixedly secured at its ends to said top and bottom members.

24. An agitator according to claim 22, wherein the hub portions of said plate parts are annular and uniform in thickness, and said fingers are integrally connected to, have the same thickness as, and extend substantially radially from respective hub portions, and are elongated and generally rectangular in cross section.

25. An agitator according to claim 24, wherein at least some of said fingers terminate in an end face which is substantially perpendicular to the radial axis of the finger.

26. An agitator according to claim 24, wherein at least some of said fingers terminate in an end face which extends at an acute angle to the radial axis of the finger.

27. An agitator according to claim 24, wherein at least some of said fingers terminate in a pair of outwardly convergent intersecting end faces.

28. An agitator according to claim 21, wherein said hub includes a generally cylindrical member, and each one of said fingers comprises a non-circular stud extending radially from said member, and including means rotatably connecting said studs to said member for adjusting the angular dispositions of the studs relative to the member.

29. An agitator according to claim 28, wherein said connecting means comprises interengaging thread means on said studs and said member respectively for adjusting said stud dispositions individually.

30. In mixing equipment, including a mixing compartment for confining therein material, including granular material, means for supplying material to be mixed to the mixing compartment, and a mulling assembly for dispersing the material in the mixing compartment, apparatus for discharging prepared material from the mixing compartment, said apparatus comprising:

means defining a discharge opening in a side wall of the mixing compartment;

door means mounted for movement between open and closed positions relative to said opening;

means for sensing the consistency of the material being dispersed;

means responsive to said sensing means for opening said door means at a predetermined first consistency, thereby to permit prepared material to overflow the bottom of said opening for discharge from the mixing compartment;

means for closing said door means and for enabling the discontinuance of the supply of material to be mixed to said mixing compartment to commence a shutdown cycle of operation during which material is retained within the mixing compartment;

retention timing means for closing said door means for a predetermined retention period of time, and subsequently for opening said door means while continuing to disperse material in said mixing compartment, to discharge the retained material from the mixing compartment; and discharge timing means for discontinuing said discharging of material from said mixing compartment after a predetermined discharge period of time, whereby the production of material is shut down with the mixing compartment at least partially empty of prepared material.

31. Mixing equipment according to claim 30, wherein said door means includes a pair of top and bottom doors adapted to move between open and closed positions relative to said opening, said top door being disposed contiguously above said bottom door in their closed positions, said retention timing means causing said top and bottom doors to be closed at the beginning of said retention period of time.

32. Mixing equipment according to claim 31, including means responsive to said sensing means for opening both of said doors at a predetermined second consistency of the dispersed material in excess of said first consistency, and means responsive to said sensing means for closing said bottom door when the consistency of the dispersed material falls below said second consistency.

33. Mixing equipment according to claim 32, including means responsive to said sensing means for terminating the supply of material to the mixing compartment after an initial predetermined time interval in the event that the consistency of the dispersed material fails to exceed a predetermined initial consistency.

34. Mixing equipment according to claim 33, including means responsive to said sensing means for indicating that the consistency of the dispersed material does not decrease below a third predetermined value in excess of said second consistency within a predetermined time interval.

35. In a method of producing prepared material, including granular material, in a mixing compartment having a mulling assembly for dispersing the material therein, the mixing compartment being defined by a bottom wall and a side wall having a discharge opening therein and spaced above the bottom wall, the steps comprising:

providing a door movable between open positions and closed positions over said opening;

supplying material to be dispersed to said mixing compartment and dispersing the material therein by said mulling assembly with said door closed;

sensing the consistency of the material being dispersed;

opening said door when the dispersed material reaches a predetermined first consistency, thereby to permit prepared material to overflow the bottom of said opening for discharging the material from the mixing compartment;

closing said door and discontinuing the supply of material to said mixing compartment to commence a shutdown cycle of operation, whereby material is retained in the mixing compartment;

discharging the material from said mixing compartment after a predetermined period of time by opening said door while continuing to disperse material in said mixing compartment, to discharge the material from the mixing compartment; and discontinuing said discharging from said mixing compartment after a predetermined discharge period of time, whereby the production of prepared material is shut down with the mixing compartment at least partially empty of prepared material.

* * * * *